US006337177B1

(12) United States Patent
Kikuchi

(10) Patent No.: US 6,337,177 B1
(45) Date of Patent: Jan. 8, 2002

(54) SILVER HALIDE COLOR PHOTOGRAPHIC MATERIAL AND IMAGE FORMATION METHOD USING THE SAME

(75) Inventor: Makoto Kikuchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/389,588

(22) Filed: Sep. 3, 1999

(30) Foreign Application Priority Data

Sep. 4, 1998 (JP) ..... 10-251538

(51) Int. Cl.[7] ..... G03C 1/46

(52) U.S. Cl. ..... 430/506; 430/448; 430/467; 430/483; 430/484; 430/485; 430/486; 430/566; 430/567; 430/505

(58) Field of Search ..... 430/448, 467, 430/483, 484, 485, 486, 506, 566, 567, 505

(56) References Cited

U.S. PATENT DOCUMENTS 4,409,321 A * 10/1983 Onodera et al. ..... 430/506
5,866,315 A * 2/1999 Hoet et al. ..... 430/569
5,879,868 A * 3/1999 Uchida ..... 430/506
6,020,118 A * 2/2000 Hashi et al. ..... 430/567

FOREIGN PATENT DOCUMENTS

JP 10-228085 A 8/1998

* cited by examiner

*Primary Examiner*—Geraldine Letscher
(74) *Attorney, Agent, or Firm*—Sughrue Mion, PLLC

(57) ABSTRACT

Disclosed is a silver halide color photographic material comprising a support, photosensitive silver halide emulsion layers grouped into at least three units according to their color sensitivities, each of which comprises a blue-sensitive, green-sensitive or red-sensitive silver halide emulsion, a color developing agent and a coupler, and a light-insensitive layer, wherein the photographic material has a total silver coverage of at most 5.0 g/m$^2$, and at least one emulsion comprised in the highest-speed emulsion layer of at least one of each unit is a tabular silver halide emulsion that comprises tabular silver halide grains having an average thickness of from 0.05 to 0.20 $\mu$m.

10 Claims, No Drawings

SILVER HALIDE COLOR PHOTOGRAPHIC MATERIAL AND IMAGE FORMATION METHOD USING THE SAME

FIELD OF THE INVENTION

The present invention relates to a silver halide color photographic material (also referred to as "photosensitive material" hereinafter) for recording images, and to an image formation method using the aforesaid photosensitive material.

BACKGROUND OF THE INVENTION

Silver halide-utilized photographic materials have undergone steadily increasing development in recent years and, at the present time, they can readily provide color images of high quality. In the system usually referred to as color photography, for instance, photographs are taken using a color negative film, and the image information recorded in the color negative film through development is printed optically into color photographic paper, thereby forming color prints. Recently, this process has attained highly advanced development to enable the spread of the so-called mini-laboratories, or small-sized simplified print processors installed in stores, as well as the color processing laboratories as large-scale local bases for highly efficient mass-production of color prints. As a result, everybody can be easily amused with color photographs now.

Lately, the APS system embodying a new concept, wherein the magnetic substance coated on the support of a color negative film is utilized for recording various kinds of information as magnetic record, has been introduced into the market. This system makes easy handling of films and proposes new ways of enjoying photographs. For instance, one can enjoy changing the print sizes and enables the recording of information at the time of photographing. In addition, tools for editing and processing the image information read from processed negative films by means of a simple scanner have been proposed. By utilizing such methods, high-quality image information from silver salt photographs can be readily converted into digital information, and so a wide range of applications going over the conventional ways of enjoying photographs are being popularized.

On the other hand, the so-called digital still cameras using CCD as image pickup elements are making rapid progress in their performance. With respect to the cameras intended for amateur use, it was these several years ago that the cameras loaded with CCD elements having more than several millions of pixels were beginning to appear on the market. Unlike general color photographic systems, the digital still cameras require no processes for developing exposed films, but they can directly provide digitized image information. Therefore, the taken images can be checked at once on a liquid crystal monitor, and the digital information obtained can be easily utilized for various purposes. For instance, such image information can be transferred to a printer, thereby making prints with ease, or it can be processed variously with a personal computer and easily transferred via Internet. The latest increase in density of CCD and the recent advance in performance of mass digital data dealing apparatus have enabled the printed images to acquire image quality worth viewing as photographs; as a result, discussion has opened up over the probability of substitution of those digital still cameras for conventional cameras used in photography.

Under these circumstances, it is desired to further pursue cheapness of silver halide photosensitive materials from the viewpoint of further development of the silver salt photographic system in opposition to the digital still camera system. From a structural point of view, it is impossible to produce digital still cameras at such a low price as lens-attached films.

Therefore, if it is possible to provide a picture-taking color negative which can be processed simply and rapidly and have a reduced processing load on environments while it retains a high photographic speed as a merit of silver halide photosensitive materials, an attractive system can be offered to users.

For lowering the production cost of picture-taking silver halide color photographic materials, it is desirable as a matter of course to realize the photosensitive materials having a layer structure reduced in silver coverage. However, it is difficult for conventional arts to surmount the problems of decreasing a photographic speed and rendering the gradation soft as the silver coverage is reduced. In other words, there are growing expectations for the development of photosensitive materials having low silver coverage but capable of ensuring high photographic speed and proper gradation even when they undergo simple and rapid processing which has a reduced load on environments, and the silver halide emulsions used therein are also called upon to have such properties.

One of the arts of increasing the photographic speed of a silver halide emulsion is using tabular grains. The use of tabular grains presents advantages of enhancing the efficiency in color sensitization to contribute to an increase in the photographic speed, improving the relation between photographic speed and granularity, elevating the sharpness by their specific optical properties, heightening the covering power, and so on. With respect to the relation between the thickness and the reflectance of tabular grains, as described in, e.g., A. E. Bohan & C. L. House *J. Imag. Sci. Tech.,* 38, 32–35(1994), it has been suggested that the light absorption by grains cannot be increased simply by decreasing the thickness of the grains, because the region where the reflectance is elevated by the interference of light comes to appear with a decrease in grain thickness.

The arts of using the tabular grains in a commonly used liquid development system, wherein the thickness of tabular grains is selected so that the spectral reflectance of the tabular-grain emulsion layer is minimized, is disclosed in, e.g., U.S. Pat. Nos. 5,275,929 and 5,302,499. The arts of using tabular grains in the developing agent incorporated type heat development system are disclosed in, e.g., JP-A-9-274295 and JP-A-10-62932 (the term "JP-A" as used herein means an "unexamined published Japanese patent application"). However, these references have no description of using thin tabular grains at a low silver coverage.

We have now found that the enhancement of soft gradation (including the sensitivity drop of lower layers), which arises from an increase of reflectance with the decrease in the thickness of tabular grains, becomes serious when the total silver coverage exceeds 5 g/m$^2$, and the sensitivity drop and the soft gradation enhancement can be reduced even under a low silver coverage condition when the developing agent-incorporated photosensitive material having a total silver coverage of at most 5 g/m$^2$, particularly the material further having heat development suitability, contains an emulsion comprising tabular silver halide grains having an average thickness of 0.20 $\mu$m or below as at least one emulsion comprised in the highest-speed emulsion layer of the light-sensitive layers having the same color sensitivity. In other words, we are the first persons to find that the use of a thin tabular-grain emulsion in a developing agent-incorporated photosensitive material having a low silver coverage, particularly when the photosensitive material is a heat-developable silver halide color photographic material for picture-taking use, is effective in preventing the sensitivity drop and soft gradation enhancement from occurring with the decrease in silver coverage.

SUMMARY OF THE INVENTION

Therefore, one object of the invention is to provide a color photographic material enabling simple and rapid image formation with a reduced load on environments.

Another object of the invention is to provide a color photographic material having a reduced silver coverage but capable of achieving high speed and appropriate gradation even when it undergoes simple and rapid processing.

As a result of our intensive study, it has been found that, even when the photosensitive material has a total silver coverage of at most 5 g/m$^2$, both sensitivity drop and enhancement of soft gradation can be unexpectedly reduced to a great extent as far as the photosensitive material comprises a tabular silver halide emulsion having an average grain thickness of 0.05 to 0.20 $\mu$m and undergoes heat development, in contrast to the case where the photosensitive material undergoes liquid development.

The aforementioned objects of the invention are attained effectively with the following embodiments:

(1) A silver halide color photographic material comprising a support, photosensitive silver halide emulsion layers, which are grouped into at least three units according to their color sensitivities, and each of which comprises a blue-sensitive, green-sensitive or red-sensitive silver halide emulsion, a color developing agent and a coupler, and a light-insensitive layer, wherein said photographic material has a total silver coverage of at most 5.0 g/m$^2$, and at least one of the emulsions in the highest-speed emulsion layer of at least one of said photosensitive silver halide emulsion layers with the same color sensitivity is a tabular silver halide emulsion that comprises tabular silver halide grains having an average thickness of from 0.05 to 0.20 $\mu$m and said tabular silver halide emulsion is an emulsion in which 100 to 80% of the total grains on a number basis are tabular silver halide grains having at least 10 dislocation lines per grain in their respective fringe parts.

(2) The silver halide color photographic material as described in Embodiment (1), wherein said total silver coverage is at most 4 g/m$^2$.

(3) The silver halide color photographic material as described in Embodiment (1), wherein said total silver coverage is at most 3 g/m$^2$.

(4) The silver halide color photographic material as described in any one of Embodiments (1) to (3), wherein said at least one of the emulsions in the highest-speed emulsion layer of said photosensitive silver halide emulsion layers with the same color sensitivity is a tabular silver halide emulsion that comprises tabular grains having an average thickness of from 0.05 to 0.15 $\mu$m.

(5) The silver halide color photographic material as described in any one of Embodiments (1) to (3), wherein said at least one of the emulsions in the highest-speed emulsion layer of said photosensitive silver halide emulsion layers with the same color sensitivity is a tabular silver halide emulsion that comprises tabular grains having an average thickness of from 0.05 to 0.10 $\mu$m.

(6) The silver halide color photographic material as described in any one of Embodiments (1) to (5), wherein at least one of said photosensitive silver halide emulsions is an emulsion comprising tabular silver halide grains having an average aspect ratio of 8 to 40.

(7) The silver halide color photographic material as described in any one of Embodiments (1) to (6), wherein said tabular silver halide emulsion is an emulsion comprising silver halide tabular grains in an amount of 100 to 50% based on the total grains on a number basis, in which the dislocation lines are localized substantially in the fringe part alone.

(8) The silver halide color photographic material as described in any one of Embodiments (1) to (7), wherein said silver halide tabular grains have at least one kind of photographically useful metal ion or complex in their respective insides.

(9) The silver halide color photographic material as described in any one of Embodiments (1) to (8), wherein said developing agent is at least one compound selected from the compounds represented by the following formulae (1) to (4):

(1)

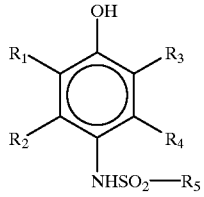

(2)

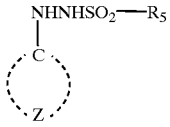

(3)

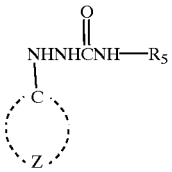

(4)

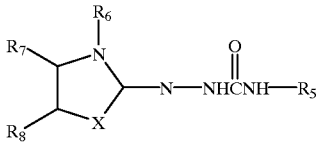

wherein each of $R_1$ to $R_2$ groups represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents atoms completing an aromatic carbocyclic or heterocyclic ring, and when the benzene ring completed by Z has substituent groups the sum total of the Hammett's $\sigma_p$ values of the substituent groups is at least 1; $R_6$ represents an alkyl group; X represents an oxygen atom, a sulfur atom, a selenium atom or a tertiary nitrogen atom having an alkyl or aryl substituent; and $R_7$ and $R_8$ each represents a hydrogen atom or a substituent group, or $R_7$ and $R_8$ combine with each other to form a double bond or a ring;

provided that each of the compounds has solubility in oil by containing at least one ballast group having at least 8 carbon atoms.

(10) The silver halide color photographic material as described in any one of Embodiments (1) to (9); said photographic material being a heat developable photosensitive material in which the images are formed by a method comprising sequentially a step of exposing imagewise the photosensitive material, a step of supplying water to the photosensitive layer side of the photosensitive material or the processing layer side of a processing material comprising a support and a base and/or base precursor-containing processing layer, the amount of said water being controlled to the range of one-tenth to equivalent with the amount required for achieving the maximum of swelling in all the coated layers of these two materials, excepting the backing layers of both materials, a step of superimposing the photosensitive material upon a processing material in a condition that the processing layer and the light-sensitive layer face each other, and a step of heating the superimposed materials for a period of from 5 to 60 seconds at a temperature of from 60° C. to 100° C.

DETAILED DESCRIPTION OF THE INVENTION

In a preferred embodiment of the present invention, the photosensitive material comprising a support, a light-insensitive layer and photosensitive silver halide emulsion layers, which are grouped into at least three units according to their color sensitivities, and each of which comprises a blue-sensitive, green-sensitive or red-sensitive silver halide emulsion, a color developing agent and a coupler, forms therein images based on at least three colored non-diffusible dyes by being superimposed upon a processing material, which comprises a support and a base and/or base precursor-containing processing layer, in a condition that the processing material and the photosensitive material face each other in the presence of water in an amount ranging from one-tenth to equivalent with the amount required for achieving the maximum of swelling in all the coated layers of these two materials, excepting the backing layers of both materials, and being heated for a period of from 5 to 60 seconds at a temperature of from 60° C. to 100° C.; and the color images based on the information obtained from the aforementioned dye images are formed on a separate recording material.

First, the silver halide emulsions used in the invention are illustrated in detail.

At least one of the silver halide emulsions used in the invention comprises tabular grains. The term "tabular grains" as used herein refers to the tabular silver halide grains having two facing parallel (111) surfaces as major planes. The present tabular grains have only one or at least two parallel twinning planes per grain.

On looking down at the present tabular grains, they have a triangular or hexagonal shape the corners of which may be sharp or round. When they have a hexagonal shape, each pair of sides facing each other have outer surfaces parallel to each other.

The twinning plane interval in the present tabular grains may be determined depending on the intended purpose. For instance, it may be controlled to at most 0.012 μm as disclosed in U.S. Pat. No. 5,219,720, or the ratio of the distance between (111) major planes to the twinning plane interval may be controlled to at least 15 as disclosed in JP-A-5-249585.

As to the present silver halide emulsion comprising tabular silver halide grains, it is desirable that the tabular grains account for 100 to 80%, preferably 100 to 90%, particularly preferably 100 to 95%, of all the grains in the emulsion on a projected area basis. When the total projected area of tabular grains is smaller than 80% of the total projected area of all the grains, the advantages of tabular grains (improvements in a speed/granularity ratio and sharpness) cannot be used to the full.

In the present emulsion comprising tabular silver halide grains, it is desirable that the hexagonal tabular grains having a ratio of adjacent sides (a longest side/shortest side ratio) in the range of 1.5 to 1 account for 100 to 50%, preferably 100 to 70%, particularly preferably 100 to 80%, of all the grains in the emulsion on a projected area basis. It is more desirable that the hexagonal tabular grains having a ratio of adjacent sides in the range of 1.2 to 1 account for 100 to 50%, preferably 100 to 70%, particularly preferably 100 to 80%, of all the grains in the emulsion on a projected area basis. Mixing with tabular grains other than the hexagonal ones is undesirable because the uniformity is lacking in the grains.

As to the tabular grains used in the invention, it is desirable that the average grain thickness thereof be from 0.05 to 0.2 μm, preferably from 0.05 to 0.15 μm, particularly preferably from 0.05 to 0.10 μm. The term average grain thickness as used herein refers to the arithmetic mean of grain thickness values of the total tabular grains in the emulsion. It is difficult to prepare the emulsion grains having an average grain thickness thinner than 0.05 μm. The emulsion grains having an average grain thickness thicker than 0.2 μm are undesirable because it is hard to achieve the effects of the invention.

The suitable average projected area diameter of the present tabular grains is from 0.8 to 4 μm, preferably from 1 to 3.5 μm, particularly preferably from 1.2 to 3 μm. The term "average projected area diameter" used herein refers to the arithmetic mean of the projected area diameter values of the total tabular grains in the emulsion. The average projected area diameter smaller than 0.8 μm is undesirable because of difficulty in achieving the present effects. And the average projected area diameter greater than 4 μm is also undesirable, because it causes deterioration in the resistance to damage by pressure.

The projected area diameter/thickness ratio of each silver halide grain is referred to as the aspect ratio. More specifically, the aspect ratio is a value obtained by dividing the diameter of a circle having the same area as the projected area of each silver halide grain by the grain thickness. As one example of a measurement method of the aspect ratio, there is known the replica method in which the transmission electron photomicrographs of silver halide grains are taken and thereby the diameter of a circle having the same area as the projected area of each grain (projected area diameter) and the thickness of each grain are determined. In this method, the thickness is calculated from the length of the replica shadow.

In the present emulsion comprising tabular silver halide grains, it is desirable that the tabular grains having an aspect ratio of 4 to 50 comprise 100 to 80% of the total silver halide grains in the emulsion on a projected area basis. In the emulsion more desirably used in the invention, the tabular grains having an aspect ratio of 6 to 50 comprise 100 to 80% of the total silver halide grains in the emulsion on a projected area basis. In particular, it is advantageous to the invention that the tabular grains having an aspect ratio of 8 to 50 comprise 100 to 80% of the total silver halide grains in the emulsion on a projected area basis.

Further, the suitable average aspect ratio for the total tabular silver halide grains in the present emulsion is from 4 to 40, preferably from 8 to 40, more preferably from 12 to 35. The term average aspect ratio refers to the arithmetic mean of the aspect ratio values of total tabular grains in the emulsion.

When the tabular grains in the emulsion are outside the scope specified above, it is hard to produce the present effects.

As to the distribution of the projected area diameters among the total tabular grains in the present emulsion, it is desirable that the variation coefficient thereof be from 35 to 3%, preferably from 25 to 3%, more preferably from 20 to 3%. The term "variation coefficient of a projected area diameter distribution" is defined as the value obtained by dividing the extent to which the projected area diameter varies from tabular grain to tabular grain (standard deviation) by the average projected area. The variation coefficient greater than 35% with respect to the projected area diameter distribution among the total tabular grains is undesirable from the viewpoint of uniformity in the grains. And the emulsions having variation coefficients smaller than 3% with respect to the projected area diameter distribution are difficult to prepare.

Although the grain thickness, the aspect ratio and the monodisperse degree can be selected from their respective ranges mentioned above depending on the intended purposes, it is advantageous to the invention to use monodisperse tabular grains having a small thickness and a high aspect ratio.

The tabular grains having high aspect ratios can be formed using various methods. For instance, the grain formation methods disclosed in U.S. Pat. Nos. 5,496,694 and 5,498,516 can be adopted in the invention. Further, the tabular grains having ultrahigh aspect ratios can be formed using the grain formation methods disclosed in U.S. Pat. Nos. 5,494,789 and 5,503,970.

In forming monodisperse tabular grains with high aspect ratios, it is important to produce twinned crystal nuclei of small sizes in a short time. For the production of such nuclei, it is desirable that the nucleation be carried out in a short time at a low temperature under the condition of high pBr and low pH in the presence of a reduced amount of gelatin. As to the type of gelatin used therein, gelatins of low molecular weight, gelatins having low methionine contents and gelatins the amino groups of which are modified with phthalic acid, trimellitic acid or pyromellitic acid are preferred.

After the nucleation, the nuclei of normal crystals, singly twinned crystals and non-parallel multiply twinned crystals are made to disappear by physical ripening, and only the nuclei of parallel doubly twinned crystals are left selectively. For heightening the monodisperse degree, it is desirable to further ripen the parallel doubly twinned nuclei left.

For elevating the monodisperse degree, it is also effective to carry out the physical ripening in the presence of PAO (polyalkylene oxide) disclosed in U.S. Pat. No. 5,147,771.

Thereafter, supplementary gelatin is added, and then a soluble silver salt and soluble halide(s) are added, thereby performing the grain growth. As the supplementary gelatin, gelatins whose amino groups are modified with phthalic acid, trimellitic acid or pyromellitic acid are also preferred.

In another favorable way to effect the grain growth, silver and halide(s) are supplied by the addition of fine grains of silver halide prepared in advance separately or those prepared in a separate reaction vessel at the same time.

The optimization by controlling the temperature, pH, binder content and pBr of reaction solutions and the feeding speeds of silver and halide ions is important in the step of grain growth also.

In forming silver halide emulsion grains used in the invention, any of silver bromide, silver chlorobromide, silver iodobromide, silver iodochloride, silver chloride and silver chloroiodobromide can be employed. However, the use of silver iodobromide or silver chloroiodobromide is preferable. When the emulsion grains have phases containing iodide or chloride, these phases may be uniformly distributed inside the grains, or localized. Other silver salts, such as silver thiocyanate, silver sulfide, silver selenide, silver carbonate, silver phosphate and silver salts of organic acids, may be present together as separate grains, or contained as part of silver halide grains.

The suitable bromide content in the present emulsion grains is at least 80 mole %, preferably at least 90 mole %.

The suitable iodide content in the present emulsion grains is from 1 to 20 mole %, preferably from 2 to 15 mole %, more preferably from 3 to 10 mole %. The iodide contents lower than 1 mole % are undesirable, because it is difficult for the grains to have the effects of intensifying the dye adsorption and increasing the intrinsic sensitivity. The iodide contents higher than 20 mole % are also undesirable, because they generally cause a decrease in development speed.

The suitable variation coefficient of the iodide content distribution among the present emulsion grains is at most 30%, preferably from 25 to 3%, more preferably from 20 to 3%. The variation coefficients greater than 30% are undesirable with respect to the uniformity in the grains. The term "the variation coefficient of an iodide content distribution among the grains" is defined as the value obtained by dividing the standard deviation regarding the iodide content in each of the emulsion grains by the average iodide content. The iodide content of each of the emulsion grains can be determined by analyzing the compositions of grains one by one with an X-ray microanalyzer. This determination method is disclosed in European Patent No. 147,868. In determining the distribution of iodide contents among the present emulsion grains, it is desirable that the number of grains to undergo one-by-one measurement of the iodide contents be at least 100, preferably at least 200, particularly preferably at least 300.

The tabular grains suitable for the invention have dislocation lines inside the grains. The introduction of dislocation lines into the tabular grains is illustrated below.

The term dislocation line refers to the linear lattice defect on the boundary between the already slipped and unslipped regions which are present in the slip plane of a crystal. As the literature concerning the dislocation lines in silver halide crystals, for example, 1) C. R. Berry, *J. Appl. Phys.,* 27, 636 (1956), 2) C. R. Berry & D. C. Skilman, *J. Appl. Phys.,* 35, 2165 (1964), 3) J. F. Hamilton, *Phot. Sci. Eng.,* 11, 57 (1967), 4) T. Shiozawa, *J. Soc. Phot. Sci. Jap.,* 34, 16 (1971), and 5) T. Shiozawa, *J. Sco. Phot. Sci. Jp.,* 35,213 (1972) can be cited. The dislocations can be analyzed by X-ray diffractiometry or direct observation with a low-temperature transmission electron microscope. In observing directly the dislocation lines by means of a transmission electron microscope, the silver halide grains are taken out from an emulsion with good care not to apply such pressure as to cause dislocations in the grains, mounted on meshes for electron microscopic observation, and observed by the transmission method in a condition that the grains are cooled so as to avoid being damaged by electron beams (e.g., print-out).

Since the thicker the grain thickness, the harder it becomes for the electron beams to be transmitted by grains, the use of a high voltage electron microscope (at least 200 kV for the grain thickness of 0.25 $\mu$m) is favorable for clearer observation.

As a literature concerning the influences of dislocation lines upon photographic properties, G. C. Farnell, R. B. Flint & J. B. Chanter, *J. Phot. Sci.,* 13, 25 (1965) can be cited. This literature teaches that, in tabular silver halide grains having large sizes and high aspect ratios, a close relation exists between the location at which latent image nuclei are formed and the defects in the grains. Further, the arts of introducing dislocation lines into silver halide grains under controlled conditions are described in, e.g., U.S. Pat. Nos. 4,806,461, 5,498,516, 5,496,694, 5,476,760 and 5,567,580, JP-A-4-149541 and JP-A-4-149737. These documents prove that the dislocation lines-introduced tabular grains are excellent in photographic characteristics, such as sensitivity and resistance to damage by pressure, compared with dislocation line-free tabular grains. The use of the emulsions disclosed in those documents is advantageous to the invention also.

In the invention, it is desirable that the introduction of dislocation lines into the inside of tabular grains be performed as follows: The dislocation lines are introduced by epitaxial growth of a silver halide phase containing silver iodide on tabular grains as substrate (host grains) and the silver halide shell(s) formation subsequent thereto.

Although it may be chosen depending on the intended purpose, the silver iodide content in host grains is desirably from 0 to 15 mole %, more desirably from 0 to 12 mole %, particularly desirably from 0 to 10 mole %. And it is undesirable to increase the silver iodide content in the host grains beyond 15 mole %, because it slows down the development.

As to the composition of a silver halide phase showing an epitaxial growth on host grains, the phase prefers having a high iodide content. The silver halide phase showing an epitaxial growth may be made up of any of silver iodide, silver iodobromide, silver chloroiodobromide and silver chloroiodide, but it is preferably made up of silver iodide or silver iodobromide, especially silver iodide. In the case of silver iodobromide, the suitable silver iodide (iodide ion) content is from 1 to 45 mole %, preferably from 5 to 45 mole %, particularly preferably from 10 to 45 mole %. Although the higher iodide content is more desirable from the viewpoint of forming misfit necessary for the introduction of dislocation lines, the iodide content of 45 mole % is the upper limit for forming silver iodobromide as solid solution.

The amount of halide added for the formation of a phase having a high silver iodide content, which achieves epitaxial growth on host grains, is desirably from 2 to 15 mole %, more desirably from 2 to 10 mole %, particularly desirably from 2 to 5 mole %, of the amount of silver in the host grains. When it is smaller than 2 mole %, it is difficult to introduce dislocation lines; while, when it is greater than 15 mole %, the development speed becomes slow.

Therein, it is desirable that the phase having a high silver iodide content be present in a proportion ranging from 5 to 60 mole %, preferably from 10 to 50 mole %, more preferably from 20 to 40 mole %, to the total amount of silver in the grains obtained after finishing the grain formation. When the proportion is lower than 5 mole % or higher than 60 mole %, it is hard to cause an increase in sensitivity by the introduction of dislocation lines.

The phase having a high silver iodide content may be formed at any location on each host grain. For instance, each host grain may be cover all over with the phase, or the phase may be formed only on particular regions of each host grain. However, it is beneficial to control the region for forming dislocation lines in each grain by selecting a particular location and thereon causing an epitaxial growth.

It is particularly advantageous to the invention to form the phase having a high silver iodide content on the edge or apex parts of each tabular host grain. In such a phase formation, the composition of halides added, the method for adding halides, and the temperature, pAg, solvent concentration, gelatin concentration and ionic strength of reaction solutions each may be arbitrarily chosen. The silver iodide content inside the grains can be measured with the analytical electron microscope as described in, e.g., JP-A-7-219102.

In forming such a high silver iodide content phase on each host grain, the method of adding a solution of water-soluble iodide, such as potassium iodide, alone or together with a solution of water-soluble silver salt, such as silver nitrate, the method of adding iodide-containing silver halide in the form of fine grains, or the method of releasing iodide ion from an iodide ion releasing agent by the reaction with an alkali or nucleophilic reagent as disclosed in, e.g., U.S. Pat. Nos. 5,498,516 and 5,527,664 can be favorably adopted in the invention.

After the epitaxial growth of the high silver iodide content phase on each host grain, a silver halide shell is formed on the outside of the host tabular grain to result in the introduction of dislocation lines. The composition of the silver halide shell may be any of silver bromide, silver iodobromide and silver chloroiodobromide, but it is preferably silver bromide or silver iodobromide.

When the silver halide shell is silver iodobromide, the suitable silver iodide content is from 0.1 to 12 mole %, preferably from 0.1 to 10 mole %, particularly preferably from 0.1 to 3 mole %.

When the silver iodide content in the shell is lower than 0.1 mole %, it is hard to achieve the effects of intensifying the adsorption of dyes, accelerating the development and so on; while, when it is higher than 12 mole %, the development speed is decreased.

The amount of silver used for the silver halide shell growth is desirably from 10 to 50 mole %, more desirably from 20 to 40 mole %, of the total amount of silver in the finished grains.

The appropriate temperature in the aforementioned process of introducing dislocation lines is from 30 to 80° C., preferably from 35 to 75° C., particularly preferably from 35 to 60° C. The temperature control at a low temperature below 30° C. or a high temperature beyond 80° C. requires a production apparatus of high performance. Viewed in production cost, therefore, the temperatures outside the range specified above are undesirable. And the appropriate pAg in the process of introducing dislocation lines is from 0.4 to 10.5.

The location and the number of the dislocation lines present in each tabular grain, based on the view from the direction perpendicular to the major plane, can be determined by the photograph of the grains taken with the aid of an electron microscope. When the dislocation lines are introduced in the present tabular grains each, the location thereof can be limited to the apex or fringe part, or it can cover the whole area of major plane. However, it is preferred to limit the location to the fringe part. The term "fringe part" as used herein refers to the periphery of each tabular grain. More specifically, as to the silver iodide distribution in the direction of the center of each tabular grain from its edges, the fringe part is defined as the outside of the point at which the iodide content first exceeds or falls short of the average iodide content in the whole grain on viewing the distribution from the periphery side.

The density of dislocation lines introduced into the present tabular grains can be selected depending on the intended purposes. For instance, it may be at least 10 lines per grain, at least 30 lines per grain, at least 50 lines per grain, or so on. However, it is desirable that the dislocation lines be introduced densely. In a case where the dislocation lines are observed standing close together or crossing one another, it is sometimes impossible to count clearly the number of dislocation lines per grain. In this case, however, they can be counted as far as the rough counting of the order of approximately 20 lines, approximately 30 lines or so on is allowable. Moreover, it is desirable in the invention that the distribution of the number of dislocation lines among grains be uniform.

In the invention, it is desirable that the silver halide tabular grains having at least 10 dislocation lines per grain account for 100 to 50%, preferably 100 to 80%, (by number) of the total grains. When the proportion of such tabular grains is lower than 50% by number, it is difficult to achieve sensitivity increasing effect. Also, it is desirable that the silver halide tabular grains having at least 50 dislocation lines per grain account for 100 to 50%, preferably 100 to 80%, (by number) of the total grains.

Further, it is desirable that the present tabular grains of silver halide are preferably uniform with one another in location of the dislocation lines introduced therein.

In the present invention, it is desirable from the viewpoint of uniformity in grain quality to heighten the proportion of silver halide tabular grains in which the dislocation lines are localized substantially in the fringe part alone. More specifically, it is desirable for the present emulsion that such tabular grains account for 100 to 50%, preferably 100 to 70%, more preferably 100 to 80%, of the total grains on a number bases. In addition, it is desirable that the fringe part of present tabular grains each be from 0.02 to 0.2 $\mu$m, preferably from 0.05 to 0.15 $\mu$m, in width. When the width of the fringe part is outside the range specified above, the increase in intrinsic sensitivity is difficult to achieve.

In determining the proportion of grains having dislocation lines and the number of the dislocation lines present therein, it is desirable that at least 100 grains, preferably at least 200 grains, particularly preferably at least 300 grains be examined for dislocation lines by direct observation.

In the invention, the silver iodide content in the fringe or apex part of each grain is measured with an analytical electron microscope in accordance with the method disclosed in JP-A-7-219102. From the viewpoint of raising the intrinsic sensitivity, it is desirable to form tabular grains having a silver halide content of at least 2 mole %, preferably at least 4 mole %, more preferably at least 5 mole % in the fringe or apex part. As to the distribution of silver iodide content insides the tabular grains, which is measured by the foregoing method utilizing an analytical electron microscope, the present tabular grains may have a higher silver iodide content in the fringe or apex part than in the core part, or vice versa. However, the former case is preferred in the invention.

It is desirable that the present tabular grains of silver halide have at least one kind of photographically useful metal ion or complex (hereinafter referred to as "metal (complex) ion") in their respective insides.

Now, the arts of doping the inside of silver halide grains with metal ions are described.

The term "photographically useful metal (complex) ions" means the dopants added to silver halide grains for the purpose of improving the photographic characteristics of a photosensitive silver halide emulsion. The metal (complex) ions added as dopants function as transitional or permanent traps for electrons or positive holes in the silver halide crystals to produce beneficial effects, such as enhancement of sensitivity and contrast, improvement in reciprocity characteristics and improvement in resistance to damage by pressure. Suitable examples of metal ions used for doping the present emulsion grains include the ions of the first to third transition metals, such as iron, ruthenium, rhodium, palladium, cadmium, rhenium, osmium, iridium, platinum, chromium and vanadium, and the ions of amphoteric metals, such as gallium, indium, thallium and lead. In doping the emulsion grains, these metal ions are used in the form of complex salt or single salt. In the case of complex ions, six-coordinate halogeno-complexes and cyano-complexes having halide ions and cyanide ions as ligands are used to advantage. In addition to these complexes, the complexes having organic ligands, such as nitrosyl (NO), thionitrosyl (NS), carbonyl (CO), thiocarbonyl (CS), isocyanato (NCO), thiocyanato (SCN), selenocyanato (SeCN), tellurocyanato (TeCN), dinitrogen ($N_2$), azido (N3), bipyridyl, cyclopentadienyl, 1,2-dithiolenyl and imidazolyl ligands, can also be used. Examples of other ligands usable for the complexes as dopants include multidentate ligands, such as bidentate ligands (e.g., bipyridyl), tridentate ligands (e.g., diethylenetriamine), tetradentate ligands (e.g., triethylenetetramine) and hexadentate ligands (e.g., ethylenediaminetetraacetato). The coordination number is preferably 6, but it may be 4. Further, the organic ligands disclosed in U.S. Pat. Nos. 5,457,021, 5,360,712 and 5,462,849 can also be used to advantage. In addition, as disclosed in U.S. Pat. No. 5,024,931, it is also desirable to incorporate metal ions as oligomer.

In incorporating metal (complex) ions into silver halide grains, it is important that the size of metal (complex) ion conforms to the lattice spacing of silver halide grains. Further, it is essential to doping silver halide grains that the compounds produced from metal (complex) ions and silver or halide ions are coprecipitated with silver halide. For the coprecipitation, it is necessary that the pKsp (the common logarithm of the reciprocal of the solubility product) of the compound constituted of a metal (complex) ion and silver or halide ion be on the same level as the pKsp of silver halide (silver chloride 9.8, silver bromide 12.3, silver iodide 16.1). Therefore, it is desirable that the pKsp of the compound constituted of a metal (complex) ion and silver or halide ion be from 8 to 20.

The amount of the above-recited metal complex used for doping silver halide grains is generally from $10^{-9}$ to $10^{-2}$ mole per mole of silver halide. To describe it in detail, it is desirable that the metal complexes providing transitional shallow electron traps in the sensitizing step be used in the range of $10^{-}$ to $10^{-2}$ mole per mole of silver halide; while the metal complexes providing deep electron traps in the sensitizing step be used in the range of $10^{-9}$ to $10^{-5}$ mole per mole of silver halide.

The content of metal (complex) ions in emulsion grains can be confirmed by the atomic absorption spectral analysis, the polarized Zeeman spectroscopic analysis or ICP analysis. The ligands in a metal complex ion can be confirmed by Infrared absorption (especially FT-IR).

The metal (complex) ions as dopant may be incorporated in the surface or inner phase of silver halide grains, or in a very shallow surface phase (the so-called subsurface) having a depth reduced to such an extent as not to expose metal ions as disclosed in U.S. Pat. Nos. 5,132,203 and 4,997,751. In other words, the location of a dopant may be chosen depending on the intended purpose. Two or more kinds of metal ions may be used as dopants, and they may be located at the same phase or separate phases. The addition of those compounds may be carried out by previously mixing the metal salt solution with either an aqueous halide solution or an aqueous silver salt solution used for grain formation, or by direct addition of the metal salt solution to the grain formation system. Further, the metal ion-doped fine silver halide emulsion grains may be added. In solving a metal salt in an appropriate solvent, such as water, methanol or acetone, it is desirable that the solution be stabilized by the addition of an aqueous solution of hydrogen halide (e.g., HCl, HBr), thiocyanic acid or salts thereof, or alkali halide (e.g., KCl, NaCl, KBr, NaBr). From the same point of view, the addition of an acid or an alkali depending on the intended purpose is also beneficial.

The doping of emulsion grains with metal ions of cyano-complexes sometimes generates cyan by the reaction between gelatin and the cyano-complexes to inhibit the gold sensitization. In such cases, as disclosed, e.g., in JP-A-6-

308653, it is desirable that the cyano-complexes be used in combination with compounds having an inhibitory function in the reaction of gelatin with the cyano-complexes. More specifically, it is desirable that the process of or after doping the emulsion grains with the metal ions of cyano-complexes be performed in the presence of metal ions capable of forming coordinate bonds with gelatin, such as zinc ion.

The methods of preparing the present silver halide emulsions mentioned above and other silver halide emulsions usable together therewith are illustrated below.

The silver halide grains used in the invention can be prepared basically in accordance with known methods, namely the methods described in, e.g., P. Glafkides, *Chimie et Physique Photographique*, Paul Montel (1967), G. F. Dufin, *Photographic Emulsion Chemistry*, The Focal Press (1966), V. L. Zelikman, et al., *Making and Coating Photographic Emulsion*, The Focal Press (1964). More specifically, the emulsions can be prepared in various pH regions, e.g., using an acid, neutral or ammoniacal process. As to the way of feeding reactant solutions, including a solution of water-soluble silver salt and a solution of water-soluble halide, any of a single jet method, a double jet method and a combination thereof can be employed. Further, the so-called controlled double jet method, wherein the addition of reactant solutions is controlled so as to maintain the pAg value at the intended value during the reaction, can be employed to advantage. Furthermore, the method of keeping the pH value constant during the reaction may be employed as well. In forming grains, it is feasible to adopt the method of controlling the solubility of silver halide by changing the temperature, pH or pAg value of the reaction system, but silver halide solvents, such as thioethers, thioureas or thiocyanates, may be added to the reaction system, too. These cases are described in, e.g., JP-B-47-11386 (the term "JP-B" as used herein means an "examined Japanese patent publication") and JP-A-53-144319.

The preparation of the silver halide grains used in the invention is generally effected by feeding a solution of water-soluble silver salt, such as silver nitrate, and a solution of water-soluble halide, such as alkali halide, into an aqueous solution of water-soluble binder, such as gelatin, under the controlled conditions. After the formation of silver halide grains, it is desirable to carry out the removal of excess water-soluble salts. The excess water-soluble salts can be removed using the noodle washing method which comprises gelling the gelatin solution containing silver halide grains, cutting into strips and washing out the water-soluble salts with cold water, or the flocculation method in which a flocculant, such as an inorganic salt containing a polyvalent anion (e.g., sodium sulfate), an anionic surfactant, an anionic polymer (e.g., sodium polystyrene sulfonate) or a gelatin derivative (e.g., an aliphatic acylated gelatin, an aromatic acylated gelatin, an aromatic carbamoylated gelatin), is added to cause the aggregation of gelatin, thereby removing the excess salts. Of these methods, the flocculation method is preferable because it enables rapid removal of excess salts.

In general, it is desirable that the silver halide emulsions used in the invention be chemical sensitized using known sensitization methods alone or in various combinations. The chemical sensitization contributes to conferring high sensitivity, exposure condition stability and storage stability upon the silver halide grains prepared. The chemical sensitization methods used to advantage is a chalcogen sensitization method using a sulfur, selenium or tellurium compound. Examples of a sensitizer usable herein include compounds capable of releasing a chalcogen element as recited above to form silver chalcogenide when added to a silver halide emulsion. The combined use of such sensitizers is desirable from the viewpoint of increasing the sensitivity and suppressing the fog. In addition, it is also desirable to adopt the precious metal sensitization method using gold, platinum, iridium or the like. In particular, the gold sensitization method using chloroauric acid alone or in combination with ions capable of coordinating to gold, such as thiocyanate ion, is advantageous because of its high sensitizing effect. Further high sensitivity can be obtained by the combined use of gold sensitization and chalcogen sensitization.

Another sensitization method used to advantage is the so-called reduction sensitization method wherein reduced silver nuclei are introduced by the use of a compound having moderate reducing power during the grain formation, thereby increasing the sensitivity. Further, the reduction sensitization method of adding an aromatic ring-containing alkinylamine compound at the time of chemical sensitization is favorably used.

In carrying out chemical sensitization, it is also desirable to control the reactivity therein by the addition of various compounds capable of adsorbing to silver halide grains. For the reactivity control, it is especially desirable to adopt the method of adding a nitrogen-containing heterocyclic compound, a mercapto compound or sensitizing dyes, such as cyanine and merocyanine dyes, prior to chalcogen sensitization and gold sensitization. The appropriate reaction conditions for chemical sensitization depend on the intended purpose. Specifically, the temperature is from 30° C. to 95° C., preferably from 40° C. to 75° C.; the pH is from 5.0 to 11.0, preferably from 5.5 to 8.5; and the pAg is from 6.0 to 10.5, preferably from 6.5 to 9.8. The arts of chemical sensitization are described in, e.g., JP-A-3-110555, JP-A-5-241267, JP-A-62-253159, JP-A-5-45833 and JP-A-62-40446. In the chemical sensitization step, it is desirable to form an epitaxial projection part on the grain surface.

The light-sensitive silver halide emulsions used in the invention are desirably subjected to the so-called spectral sensitization to acquire sensitivities in the desired wavelength regions. In particular, photosensitive layers having sensitivities to blue, green and red lights respectively are incorporated in a color photographic material for the purpose of reproducing colors faithful to an original. These color sensitivities are conferred by spectrally sensitizing silver halide with the so-called spectral sensitizing dyes. Such sensitizing dyes include cyanine dyes, merocyanine dyes, complex cyanine dyes, complex merocyanine dyes, holopolar dyes, hemicyanine dyes, styryl dyes and hemioxonol dyes. Examples of these dyes are disclosed in U.S. Pat. No. 4,617,257, JP-A-59-180550, JP-A-64-13546, JP-A-5-45828, JP-A-5-45834 and soon. Those spectral sensitizing dyes are used alone or as a combination of two or more thereof. The combination of dyes is employed for the purpose of controlling the wavelength distribution of spectral sensitivity or obtaining supersensitizing effect. The supersensitizing combination of dyes can achieve the sensitivity materially greater than the sum of the sensitivities achieved by individual dyes. Further, it is also desirable to employ compounds which can exhibit a supersensitizing effect in combination with a certain sensitizing dye although they themselves do not spectrally sensitize silver halide emulsion or do not absorb light in the visible region. Such supersensitizing compounds include diaminostilbene compounds. Examples thereof are disclosed in U.S. Pat. No. 3,615,641, JP-A-63-23145 and so on. Those spectral sensitizing dyes and supersensitizing compounds may be added to silver halide emulsions at any stage of emulsion-making. Specifically, they may be added to a chemically sensitized emulsion at the time of preparing a coating solution using the emulsion, or their addition to an emulsion may be at the conclusion of, during or prior to chemical sensitization, or they may be added within a period from the completion of grain formation to the start of desalting, during the grain formation or prior to the grain formation. These ways of addition may be adopted independently or as combination of two or more thereof. For achievement of high sensitivity, the addition in steps prior to chemical sensitization is effective. The spectral sensitizing dyes and supersensitizing compounds each can be added in an amount chosen from a wide range depending on the shape and size of emulsion grains and the photographic characteristics intended to be conferred thereby. In general, however, the addition amount ranges from $10^{-8}$ to $10^{-1}$ mole, preferably from $10^{-5}$ to $10^{-2}$ mole, per mole of silver halide. Those compounds are dissolved in an organic solvent, such as methanol or fluorinated alcohol, or dispersed into water together with a surfactant and gelatin, and then added to silver halide emulsions.

The silver halide emulsions used in the invention can contain a wide variety of stabilizers for purposes of preventing fogging or heightening stability during storage. Suitable examples of a stabilizer include nitrogen-containing heterocyclic compounds such as azaindenes, triazoles, tetrazoles and purines, and mercapto compounds such as mercaptotetrazoles, mercaptotriazoles, mercaptoimidazoles and mercaptothiadiazoles. The detials of these compounds are described in T. H. James, *The Theory of the Photographic Process*, pages 396–399, Macmillan (1977) and the references cited therein. Of those antifoggants, the mercaptoazoles having an alkyl group containing at least 4 carbon atoms and two or more aromatic groups as substituents are preferably used in the invention. Such antifoggants or stabilizers may be added to silver halide emulsions at any stage of emulsion-making. Specifically, they may be added within a period from the conclusion of chemical sensitization to the start of preparing a coating solution, at the conclusion of, during or prior to chemical sensitization, within a period from the completion of grain formation to the start of desalting, during the grain formation, or prior to the grain formation. These ways of addition may be adopted independently or as combination of two or more thereof. Those antifoggants or stabilizers can be added in an amount chosen from a wide range depending on the halide composition of emulsion grains and the required purpose. In general, however, the addition amount ranges from $10^{-6}$ to $10^{-1}$ mole, preferably from $10^{-5}$ to $10^{-2}$ mole, per mole of silver halide.

The aforementioned photographic additives which are usable in the invention are described in *Research Disclosure* (abbreviated as "RD"), No. 17643 (December, 1978), No. 18716 (November, 1979) and No. 307105 (November, 1989). The locations where the additives are described in each of those references are listed below.

| Kinds Of Additives | RD-17643 | RD-18716 | RD-307105 |
|---|---|---|---|
| Chemical sensitizer | p. 23 | p. 648, right column | p. 866 |
| Sensitivity increasing agent | | p. 648, right column | |
| Spectral sensitizer and Supersensitizer | pp. 23–24 | p. 648, right column, to p. 649, right column | pp. 866–868 |
| Brightening agent | p. 24 | p. 648, right column | p. 866 |
| Antifoggant and Stabilizer | pp. 24–26 | p. 649, right column | pp. 868–870 |

-continued

| Kinds Of Additives | RD-17643 | RD-18716 | RD-307105 |
|---|---|---|---|
| Light absorbent, Filter dye, and UV absorbent | pp. 25–26 | p. 649, right column, to p. 650, left column | p. 873 |
| Dye image stabilizer | p. 25 | p. 650, left column | p. 872 |
| Hardener | p. 26 | p. 651, left column | pp. 874–875 |
| Binder | p. 26 | p. 651, left column | pp. 873–874 |
| Plasticizer and Lubricant | p. 27 | p. 650, right column | p. 876 |
| Coating aid and Surfactant | pp. 26–27 | p. 650, right column | pp. 875–876 |
| Antistatic agent | p. 27 | p. 650, right column | pp. 876–877 |
| Matting agent | | | pp. 878–879 |

In the invention, it is also possible to use organic metal salts as oxidizing agent together with light-sensitive silver halide. Of such organic metal salts, organic silver salts are preferred in particular.

Examples of an organic compound usable for the formation of an organic silver salt as oxidizing agent include the benzotriazoles disclosed in U.S. Pat. No. 4,500,626, columns 52–53, and fatty acids. In addition, acetylene silver disclosed in U.S. Pat. No. 4,775,613 is also useful. Those organic silver salts may be used as a mixture of two or more thereof. Such an organic silver salt can be used in an amount of 0.01 to 10 moles, preferably 0.01 to 1 mole, per mole of light-sensitive silver halide.

The binders used for constituent layers of the present photographic material are preferably hydrophilic ones as described in *Research Disclosure*, the above-cited numbers, and JP-A-64-13546, pages 71–75. More specifically, transparent or translucent hydrophilic binders are preferred. Examples of such binder include natural compounds, such as proteins (e.g., gelatin, gelatin derivatives) and polysaccharides (e.g., cellulose derivatives, starch, gum arabic, dextran, pullulan), and synthetic macromolecular compounds, such as polyvinyl alcohol, modified polyvinyl alcohols (e.g., terminal alkyl-modified Poval MP103 and MP203 produced by Kraray Co., Ltd.), polyvinyl pyrrolidone and acrylamide polymers. In addition, the binders having high water-absorbing power as disclosed in, e.g., U.S. Pat. No. 4,960,681 and JP-A-62-245260, specifically homopolymers of vinyl monomers having —COOM or —$SO_3$M (wherein M is a hydrogen atom or an alkali metal), copolymers of vinyl monomers which are different from each other but have the foregoing group and copolymers of vinyl monomers having the foregoing group and other vinyl monomers (e.g., sodium methacrylate, ammonium methacrylate), such as Sumica Gel L-5H produced by Sumitomo Chemical Co., Ltd., can also be employed. These binders can be used as a combination of two or more thereof. In particular, the combined use of gelatin and another binder as recited above is preferred. The gelatin can be selected properly from lime-processed gelatin, acid-processed gelatin and the so-called delimed gelatin, or gelatin reduced in contents of calcium and the like, depending on various purposes. It is also desirable to use these types of gelatin as a mixture. The suitable coverage of binder in the invention is from 1 to 20 g/m$^2$, preferably 2 to 15 g/m$^2$, more preferably from 3 to 12 g/m$^2$. The proportion of gelatin to the total binders is from 50 to 100%, preferably from 70 to 100%.

Further, the present photographic material contains developing agent(s). The compounds of formula (1), (2), (3) or (4) illustrated above are favorably employed as the developing agent(s).

The compounds represented by formula (1) are compounds generically referred to as sulfonamidophenols.

Each of the substituents $R_1$ to $R_4$ in formula (1) represents a hydrogen atom, a halogen atom (e.g., chlorine bromine), an alkyl group (e.g., methyl, ethyl, isopropyl, n-butyl, t-butyl), an aryl group (e.g., phenyl, tolyl, xylyl), an alkylcarbonamido group (e.g., acetylamino, propionylamino, butyroylamino), an arylcarbonamido group (e.g., benzoylamino), an alkylsulfonamido group (e.g., methanesulfonylamino, ethanesulfonylamino), an arylsulfonamido group (e.g., benzenesulfonylamino, toluenesulfonylamino), an alkoxy group (e.g., methoxy, ethoxy, butoxy), an aryloxy group (e.g., phenoxy), an alkylthio group (e.g., methylthio, ethylthio, butylthio), an arylthio group (e.g., phenylthio, tolylthio), an alkylcarbamoyl group (e.g., methylcarbamoyl, dimethylcarbamoyl, ethylcarbamoyl, diethyl carbamoyl, dibutyl carbamoyl, peperidylcarbamoyl, morpholylcarbamoyl), an arylcarbamoyl group (e.g., phenylcarbamoyl, methylphenylcarbamoyl, ethylphenylcarbamoyl, benzylphenylcarbamoyl), a carbamoyl group, an alkylsulfamoyl group (e.g., methyl sulfamoyl, dimethylsulfamoyl, ethyl-sulfamoyl, diethylsulfamoyl, dibutylsulfamoyl, piperidylsulfamoyl, morpholylsulfamoyl), an arylsulfamoyl group (e.g., phenylsulfamoyl, methylphenylsulfamoyl, ethylphenylsulfamoyl, benzylphenylsulfamoyl), a sulfamoyl group, a cyano group, an alkylsulfonyl group (e.g., methanesulfonyl, ethanesulfonyl), an arylsulfonyl group (e.g., phenylsulfonyl, 4-chlorophenylsulfonyl, p-toluenesulfonyl), an alkoxycarbonyl group (e. g., methoxycarbonyl, ethoxycarbonyl, butoxycarbonyl), an aryloxycarbonyl group (e.g., phenoxycarbonyl), an alkylcarbonyl group (e.g., acetyl, propionyl, butyroyl), an arylcarbonyl group (e.g., benzoyl, alkylbenzoyl) or an acyloxy group (e.g., acetyloxy, propionyloxy, butyroyloxy). Of the substituents $R_1$ to $R_4$, both $R_2$ and $R_4$ are preferably hydrogen atoms. Further, it is desirable that the Hammett's $\sigma_p$ values of substituents $R_1$ to $R_4$ have a total of at least zero. $R_5$ represents an alkyl group (e.g., methyl, ethyl, butyl, octyl, lauryl, cetyl, stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl, 3,5-di-(methoxycarbonyl)), (methoxycarbonyl) or a heterocyclic group (e.g., pyridyl).

The alkyl group (residue), the aryl group (residue) and heterocyclic group represented by $R_1$ to $R_5$ each may be further substituted with the atom(s) or/and groups recited as examples of $R_1$ to $R_4$ each.

The compounds of formula (2) are compounds generically referred to as sulfonylhydrazines. And the compounds of formula (3) are compounds generically referred to as carbamoylhydrazines.

In these formulae, Z represents atoms completing an aromatic ring. The aromatic ring completed by Z is required to be sufficiently electron-attracting for imparting silver developing activity to the present compound. For satisfying this requirement, it is advantageous for Z to complete a nitrogen-containing aromatic ring or a benzene ring onto which electron-attracting group(s) is(are) introduced. Suitable examples of such an aromatic ring include a pyridine ring, a pyrazine ring, a pyrimidine ring, a quinoline ring and quinoxaline ring. In a case where the ring completed by Z is a benzene ring, examples of a substituent group which can be introduced onto the benzene ring include alkylsulfonyl groups (e.g., methanesulfonyl, ethanesulfonyl), halogen atoms (e.g., chlorine, bromine), alkylcarbamoyl groups (e.g., methylcarbamoyl, dimethylcarbamoyl, ethylcarbamoyl diethylcarbamoyl, dibutylcarbamoyl, piperidylcarbamoyl, morpholylcarbamoyl), arylcarbamoyl groups (e.g., phenylcarbamoyl, methylphenylcarbamoyl, ethylphenylcarbamoyl, benzylphenylcarbamoyl), a carbamoyl group, alkylsulfamoyl groups (e.g., methylsulfamoyl, dimethylsulfamoyl, ethylsulfamoyl, diethylsulfamoyl, dibutylsulfamoyl, piperidylsulfamoyl, morpholylsulfamoyl), arylsulfamoyl groups (e.g., phenylsulfamoyl, methylphenylsulfamoyl, ethylphenylsulfamoyl, benzylphenylsulfamoyl), a sulfamoyl group, a cyano group, alkylsulfonyl groups (e.g., methanesulfonyl, ethanesulfonyl), arylsulfonyl groups (e.g., phenylsulfonyl, 4-chlorophenylsulfonyl, p-toluenesulfonyl), alkoxycarbonyl groups (e.g., methoxycarbonyl, ethoxycarbonyl, butoxycarbonyl), aryloxycarbonyl groups (e.g., phenoxycarbonyl) alkylcarbonyl group (e.g., acetyl, propionyl, butyroyl) and arylcarbonyl groups (e.g., benzoyl, alkylbenzoyl). Only the Hammett's □ values of substituent groups introduced onto the benzene ring come to a total of at least 1.

The compounds represented by formula (4) are compounds generically referred to as carbamoylhydrazones.

In formula (4), $R_6$ represents a substituted or unsubstituted alkyl group (e.g., methyl, ethyl); X represents an oxygen atom, a sulfur atom, a selenium atom or an alkyl- or aryl-substituted tertiary nitrogen atom, preferably an alkyl-substituted tertiary nitrogen atom; and $R_7$ and $R_8$ each represent a hydrogen atom or a substituent group, or $R_7$ and $R_8$ are combined with each other to form a double bond or a ring.

Examples of a substituent group represented by $R_7$ and $R_8$ each include the alkyl, aryl and heterocyclic groups recited above as examples of $R_5$. Examples of a ring formed by combining $R_7$ and $R_8$ include 5- to 6-membered carbon rings (e.g., benzene ring) and nitrogen-containing heterocyclic rings (e.g., pyridine, pyrrole, thiophene).

Examples of compounds represented by formulae (1) to (4) are illustrated below, but it should be understood that these examples are not to be construed as limiting the scope of the invention in any way.

D-1
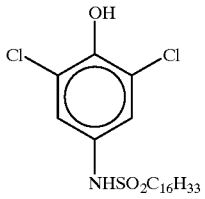
D-2
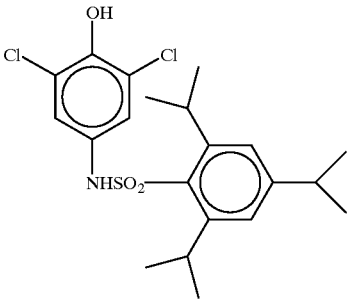
D-3
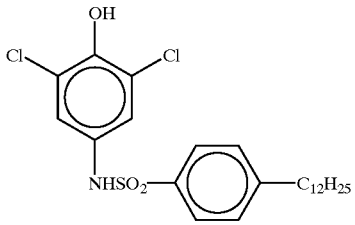
D-4
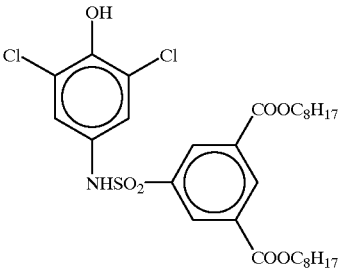
D-5
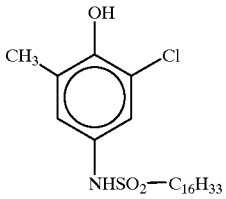
D-6
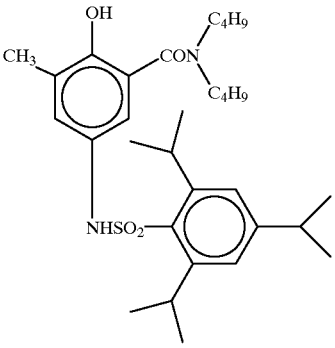
D-7
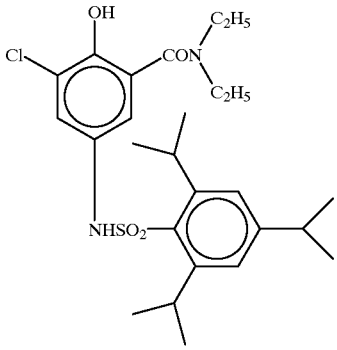
D-8
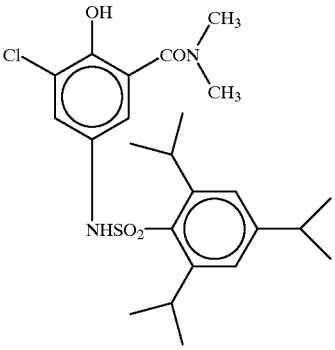

-continued
D-9
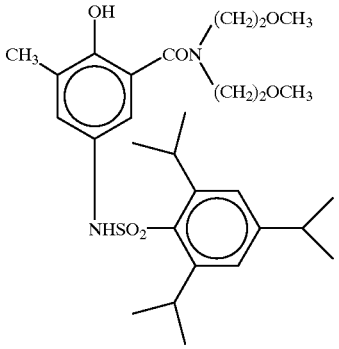
D-10
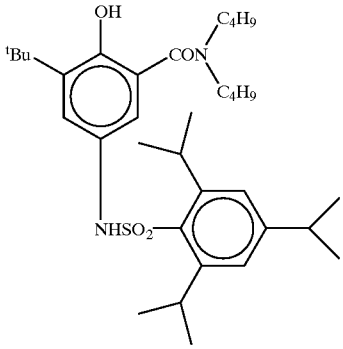
D-11
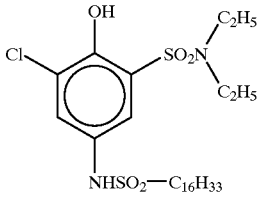
D-12
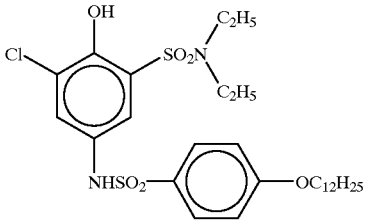
D-13
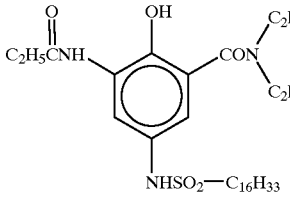
D-14
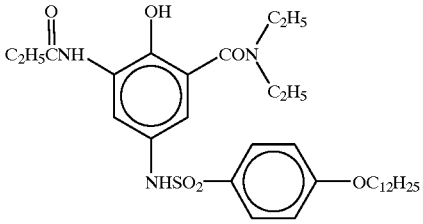
D-15
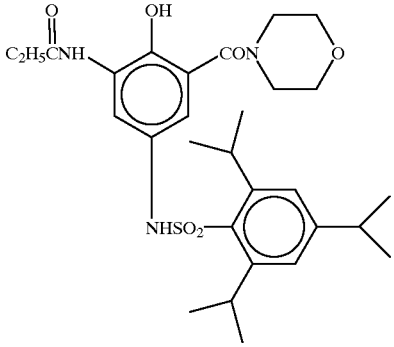
D-16
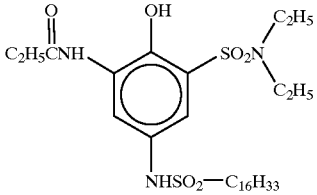
D-17
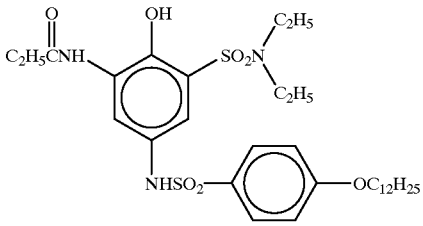
D-18
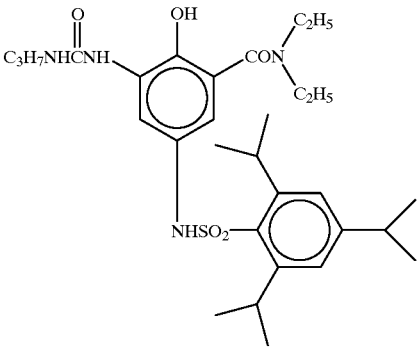

-continued
D-19
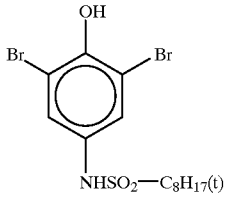
D-20
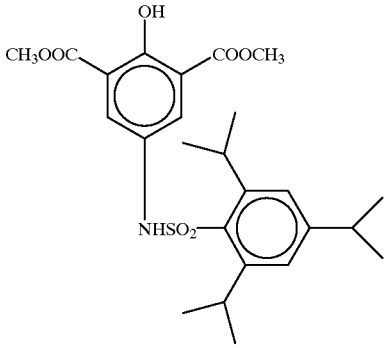
D-21
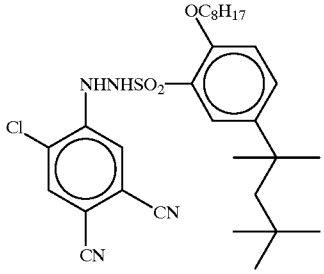
D-22
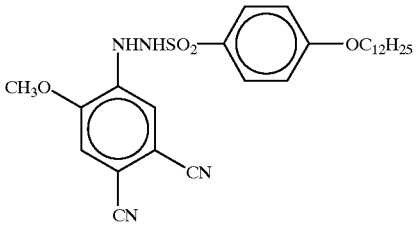
D-23
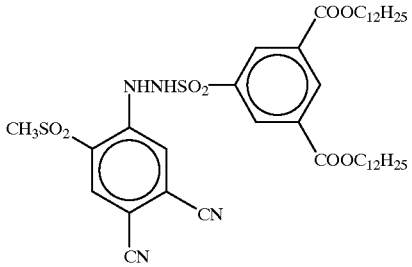
D-24
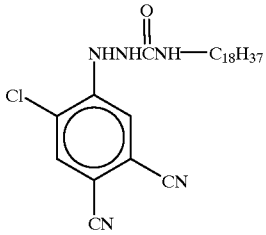
D-25
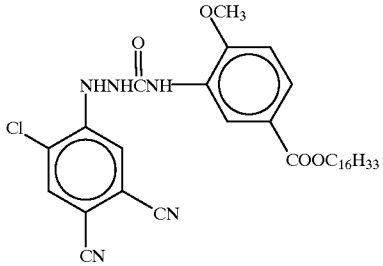
D-26
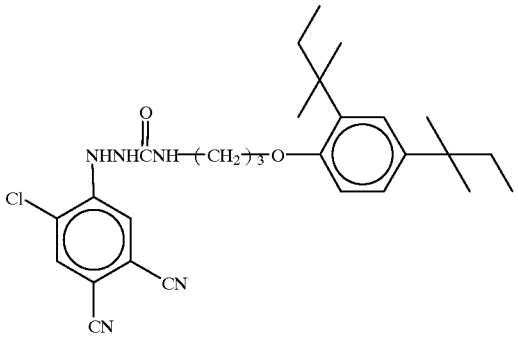
D-27
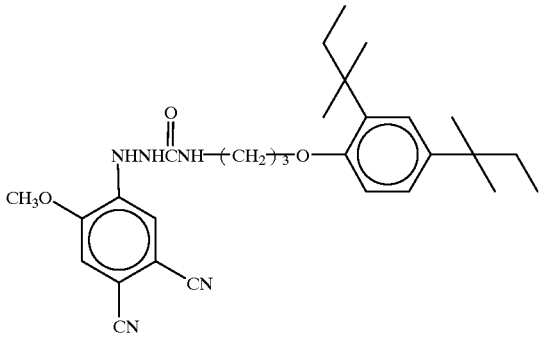
D-28
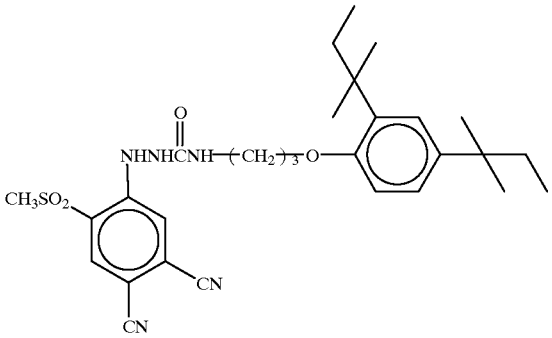

-continued
D-29
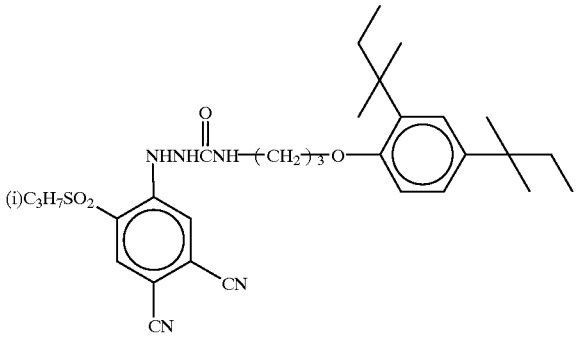
D-30
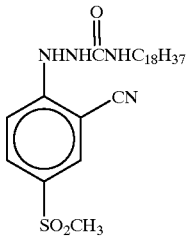
D-31
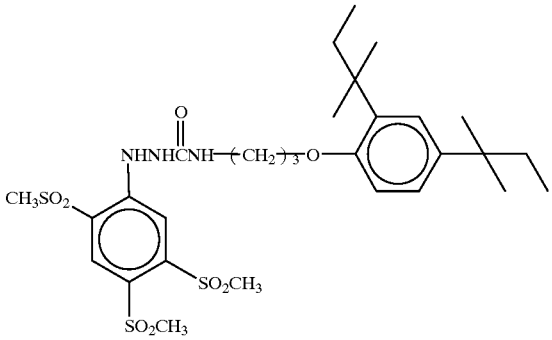
D-32
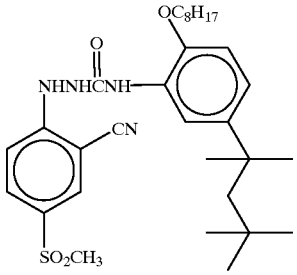
D-33
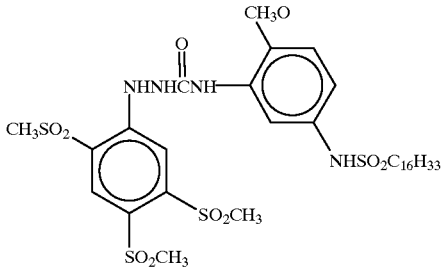
D-34
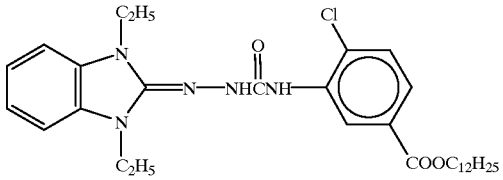
D-35
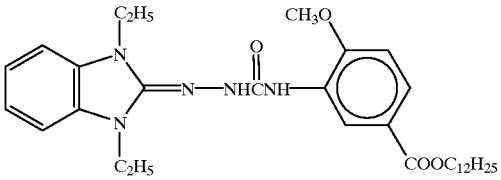
D-36
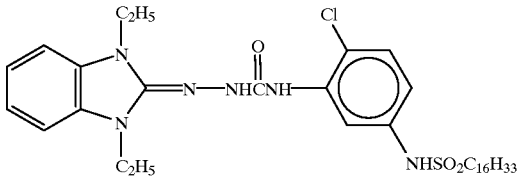
D-37
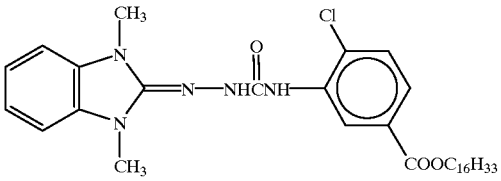
D-38
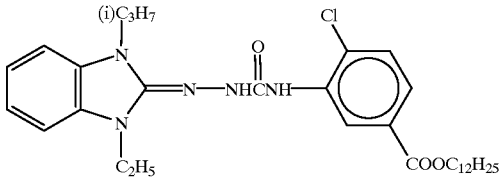
D-39
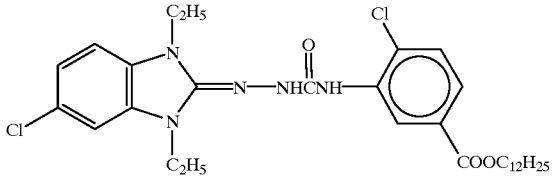
D-40
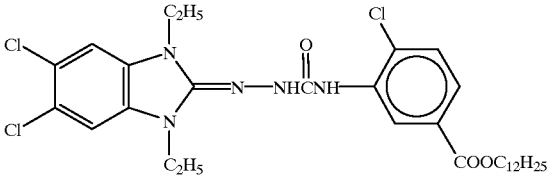

-continued

D-41

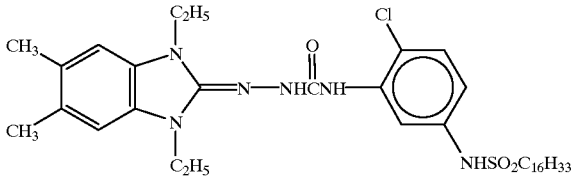

D-42

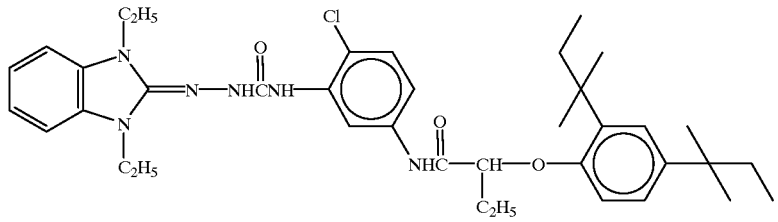

D-43

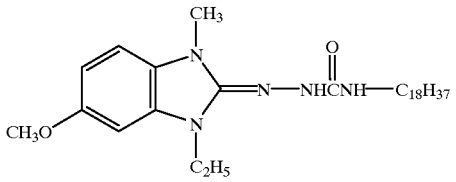

D-44

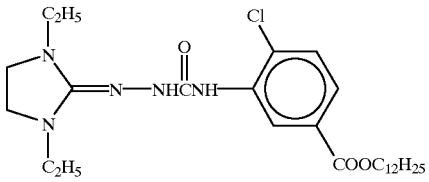

D-45

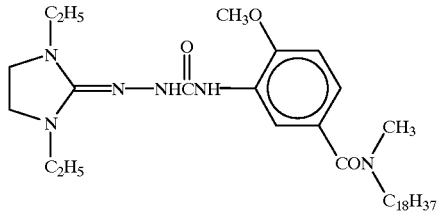

D-46

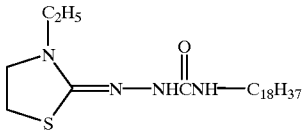

D-47

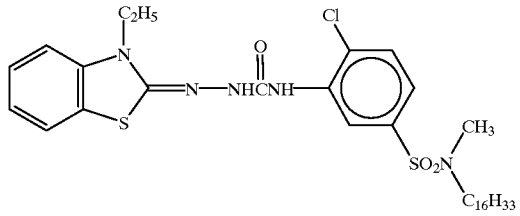

D-48

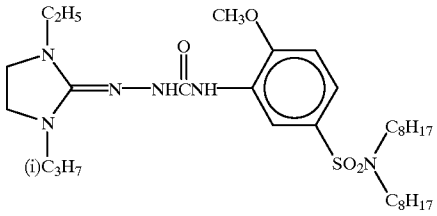

One or more of the foregoing compounds are employed as color developing agent. It is also possible to use different developing agents in constituent layers respectively. The total amount of these developing agents used is from 0.05 to 20 mmol/$m^2$, preferably from 0.1 to 10 mmol/$m^2$.

Next, couplers are illustrated. The term "couplers" as used herein refers to the compounds forming dyes by the coupling reaction with the oxidation products of color developing agents.

Suitable examples of couplers used in the invention include active methylene compounds, 5-pyrazolone compounds, pyrazoloazole compounds, phenol compounds, naphthol compounds and pyrrolotriazole compounds. As these compounds, the compounds recited in RD No. 38957, "X. Dye image formers and modifiers", pp. 616–624 (September, 1996) can be advantageously employed. Those couplers can be divided into two groups, two equivalent couplers and four equivalent couplers. Examples of a group functioning as the anionic splitting-off group of a two equivalent coupler include halogen atoms (e.g., chlorine, bromine), alkoxy groups (e.g., methoxy, ethoxy), aryloxy groups (e.g., phenoxy, 4-cyanophenoxy, 4-alkoxycarbonylphenyl), alkylthio groups (e.g., methylthio, ethylthio, butylthio), arylthio groups (e.g., phenylthio, tolylthio), alkylcarbamoyl groups (e.g., methylcarbamoyl, dimethylcarbamoyl, ethylcarbamoyl, diethylcarbamoyl, dibutylcarbamoyl, piperidylcarbamoyl, morpholylcarbamoyl), arylcarbamoyl groups (e.g., phenylcarbamoyl, methylphenylcarbamoyl, ethylphenylcarbamoyl, benzylphenylcarbamoyl), a carbamoyl group, alkylsulfamoyl groups (e.g., methylsulfamoyl, dimethylsulfamoyl, ethylsulfamoyl, diethylsulfamoyl, dibutylsulfamoyl, piperidylsulfamoyl, morpholylsulfamoyl), arylsulfamoyl groups (e.g., phenylsulfamoyl, methylphenylsulfamoyl, ethylphenylsulfamoyl, benzylphenylsulfamoyl), a sulfamoyl group, a cyano group, alkylsulfonyl groups (e.g., methanesulfonyl, ethanesulfonyl), arylsulfonyl groups (e.g., phenylsulfonyl, 4-chlorophenylsulfonyl, p-toluenesulfonyl), alkylcarbonyloxy groups (e.g., acetyloxy, propionyloxy, butyroyloxy), arylcarbonyloxy groups (e.g., benzoyloxy, toluyloxy, anisyloxy) and nitrogen-containing heterocyclic groups (e.g., imidazolyl, benzotriazolyl). On the other hand, examples of a group functioning as the cationic splitting-off group of a four equivalent coupler include a hydrogen atom, a formyl group, a carbamoyl group, a substituted methylene group (the substituent of which is, e.g., an aryl group, a sulfamoyl group, a carbamoyl group, an alkoxy group, an amino group or a hydroxyl group), an acyl group and a sulfonyl group.

Besides the compounds described in RD No. 38957, the couplers recited below can be favorably used.

Appropriate examples of an active methylene coupler include the couplers represented by formulae (I) and (II) in EP-A-0502424; the couplers represented by formulae (1) and (2) in EP-A-0513496; the couplers represented by formula (I) in claim 1 of EP-A-0568037; the couplers represented by formula (I) on column 1, lines 45–55, of U.S. Pat. No. 5,066,576; the couplers represented by formula (I) in paragraph [0008] of JP-A-4-274425: the couplers described in claim 1 on page 40 of EP-A1-0498381; the couplers represented by formula (Y) on page 4 of EP-A1-0447969; and the couplers represented by formulae (II) to (IV) on column 7, lines 36–58, of U.S. Pat. No. 4,476,219.

Appropriate examples of a magenta coupler of 5-pyrazolone type include the compounds disclosed in JP-A-57-35858 and JP-A-51-20826. Suitable examples of pyrazoloazole couplers include the imidazo[1,2-b]pyrazoles disclosed in U.S. Pat. No. 4,500,630, the pyrazolo[1,5-b][1,2,4]triazoles disclosed in U.S. Pat. No. 4,540,654, and the pyrazolo[5,1-c][1,2,4]triazoles disclosed in U.S. Pat. No. 3,725,067. Of these couplers, the pyrazolo[1,5-b][1,2,4] triazoles are preferred over the others from the viewpoint of light fastness. Suitable examples of phenol couplers include the 2-alkylamino-5-alkylphenol couplers as disclosed in U.S. Pat. Nos. 2,369,929, 2,810,171, 2,772,162, 2,895,826 and 3,772,002; the 2,5-diacylaminophenol couplers as disclosed in U.S. Pat. Nos. 2,772,162, 3,758,308, 4,126,396, 4,334,011 and4,327,173, West German Patent Application (OLS) No. 3,329,729, and JP-A-59-166956; and the 2-phenylureido-5-acylaminophenol couplers as disclosed in U.S. Pat. Nos. 3,446,622, 4,333,999, 4,451,559 and 4,427,767. Suitable examples of naphthol couplers include the 2-carbamoyl-1-naphthol couplers as disclosed in U.S. Pat. Nos. 2,474,293, 4,052,212, 4,146,396, 4,228,233 and 4,296,200; and the 2-carbamoyl-5-amido-1-naphthol couplers as disclosed in U.S. Pat. No. 4,690,889. Suitable examples of pyrrolotriazole couplers include the couplers disclosed in EP-A1-0488248, EP-A1-0491197 and EP-A1-0545300. In addition to the couplers recited above, the couplers having particular structures, such as ring-condensed phenols, imidazoles, pyrroles, 3-hydroxypyridines, active methylenes, 5,5-condensed hetero rings or 5,6-condensed hetero rings, can also be used. Specifically, the ring-condensed phenol couplers which can be used include the couplers disclosed in U.S. Pat. Nos. 4,327,173, 4,564,586 and 4,904,575. The imidazole couplers which can be used include the couplers disclosed in U.S. Pat. Nos. 4,818,672 and 5,051,347. The pyrrole couplers which can be used include the couplers disclosed in JP-A-4-188137 and JP-A-4-190347. The 3-hydroxypyridine couplers which can be used include the couplers disclosed in JP-A-1-315736. The active methylene couplers which can be used include the couplers disclosed in U.S. Pat. Nos. 5,104,783 and 5,162,196. The 5,5-condensed hetero ring couplers which can be used include the pyrrolopyrazole couplers disclosed in U.S. Pat. No. 5,164,289 and the pyrroloimidazole couplers disclosed in JP-A-4-174429. The 5,6-condensed hetero ring couplers which can be used include the pyrazolopyrimidine couplers disclosed in U.S. Pat. No. 4,950,585, the pyrrolotriazine couplers disclosed in JP-A-4-204730 and the couplers disclosed in European Patent 0,556,700 are examples thereof. Besides the couplers recited above, the couplers disclosed in West German Patent Application (OLS) No. 3,819,051, West German Patent 3,823,049, U.S. Pat. Nos. 4,840,883, 5,024,930, 5,051,347 and 4,481,268, EP-A2-0304856, European Patent 0,329,036, EP-A2-0354549, EP-A2-0374781, EP-A2-0379110, EP-A1-0386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 can be used in the invention. The couplers as recited above are used in an amount of 0.05 to 10 mmol/$m^2$, preferably 0.1 to 5 mmol/$m^2$, per each color.

Furthermore, colored couplers for correcting unnecessary absorption of color-developed dyes and compounds (including couplers) releasing photographically useful compound residues, such as a development inhibitor, by reacting with oxidation products of developing agents can be used in the invention, too.

The present photographic material comprises at least three light-sensitive layers different from one another in spectral sensitivity. Each of the light-sensitive layers, although contains at least one silver halide emulsion layer, is typically constituted of two or more silver halide emulsion layers having substantially the same color sensitivity but different photographic speeds. Therein, it is desirable that the silver halide grains having greater projected area diameter be tabular grains having the higher aspect ratio (wherein the term aspect ratio is defined as the ratio of the projected area diameter to the thickness of each grain). More specifically, each of the light-sensitive layers is a unit light-sensitive layer having color sensitivity to any of blue light, green light and red light. As to the arranging order of unit light-sensitive layers in a multi-layer silver halide color photographic material, the unit red-sensitive layer, the unit green-sensitive layer and the unit blue-sensitive layer are generally arranged in this order, based on the distance from the support. However, if desired, the foregoing arranging order may be reversed, or other arranging orders may be adopted wherein a constituent layer of one unit light-sensitive layer is inserted between constituent layers of another unit light-sensitive layer.

The total thickness of light-sensitive layers is generally from 1 to 20 $\mu$m, preferably from 3 to 15 $\mu$m.

As to the colored layers using oil-soluble dyes which can be converted to colorless compounds by processing, the yellow filter layer, the magenta filter layer and the antihalation layer can be employed in the invention. These layers are arranged, e.g., as follows: In a case where the support, the red-sensitive layer, the green-sensitive layer and the blue-sensitive layer are arranged in this order, the yellow filter layer is provided between the blue-sensitive layer and the green-sensitive layer, the magenta filter layer is provided between the green-sensitive layer and the red-sensitive layer, and the cyan filter layer (antihalation layer) is provided between the red-sensitive layer and the support. The colored layers each may contact directly with emulsion layers, or an interlayer of gelatin or the like may lie between the colored layer and the emulsion layer. The amount of dye used is adjusted so that the layer colored with the dye has a transmission density of from 0.03 to 3.0, preferably from 0.1 to 1.0, when exposed to blue, green or red light corresponding thereto. More specifically, the amount of dye used, though depends on the $\epsilon$ and molecular weight of the dye, is generally from 0.005 to 2.0 millimole/$m^2$, preferably from 0.05 to 1.0 millimole/$m^2$.

Examples of usable dyes include the compounds disclosed in JP-A-10-207027, the structures of which are each made up of a methine group and two different groups selected from among the acidic nuclei derived from cyclic ketomethylene compounds (e.g., 2-pyrazoline-5-one, 1,2,3,6-tetrahydropyridine-2,6-dione, rhodanine, hydantoin, thiohydantoin, 2,4-oxazolidinedione, isooxazolone, barbituric acid, thiobarbituric acid, indanedione, dioxopyrazolopyridine, hydroxypyridine, pyrazolidinedione, 2,5-dihydrofuran-2-one, pyrroline-2-one) or the compounds having a methylene group sandwiched between electron-attracting groups, such as —CN, $—SO_2R_1$, $—COR_1$, $—COOR_1$, $—CON(R_2)_2$, $—SO_2N(R_2)_2$, $—C[=C(CN)_2]R_1$ and $—C[=C(CN)_2]N(R_1)_2$ (wherein $R_1$ represents an alkyl group, an alkenyl group, an aryl group, a cycloalkyl group or a heterocyclic group, and $R_2$ represents a hydrogen atom or has the same meaning as R1), basic nuclei (e.g., nuclei of pyridine, quinoline, indolenine, oxazole, imidazole, thiazole, benzoxazole, benzimidazole, benzothiazole, oxazoline, naphthoxazole, pyrrole), aryl groups (e.g., phenyl, naphthyl) and heterocyclic groups (e.g., groups derived from pyrrole, indole, furan, thiophene, imidazole, pyrazole, indolidine, quinoline, carbazole, phenothiazine, phenoxazine, indoline, thiazole, pyridine, pyridazine, thiadiazine, pyran, thiopyran, oxadiazole, benzoquinoline, thiadiazole, pyrrolothiaizole, pyrrolopyridazine, tetrazole, oxazole, coumarin, cumarone); and the compounds of formula $(NC)_2C=C(CN)—R_3$ (wherein $R_3$ represents an aryl group or a heterocyclic group).

The present photographic material may use a mixture of two or more dyes in each of the colored layers. For instance, the mixture of three kinds of dyes, namely yellow, magenta and cyan dyes, can be used in the antihalation layer.

Preferably, the decolorizable dyes are used in a state that they are dissolved in an oil and/or oil-soluble polymer and dispersed as oil droplets into a hydrophilic binder. It is desirable that such a dispersion be prepared by an emulsified dispersion method, e.g., the method disclosed in U.S. Pat. No. 2,322,027. Therein, the high boiling oils as disclosed in U.S. Pat. Nos. 4,555,470, 4,536,466, 4,587,206, 4,555,476 and 4,599,296 and JP-B-3-62256 can be employed, if needed, in combination with low boiling organic solvents having a boiling point in the range of 50–160° C. Additionally, those high boiling oils can be used alone or as a combination of two or more thereof. It is also possible to use oil-soluble polymers in place of or in combination with the oils. Such cases are disclosed in PCT World Open WO88/00723. The amount of high boiling oil(s) and/or polymer(s) used is from 0.01 to 10 g, preferably from 0.1 to 5 g, per gram of dyes.

On the other hand, the dyes can be dissolved into polymers according to a latex dispersion method. The steps of this method and examples of a latex for impregnation use are disclosed, e.g., in U.S. Pat. No. 4,199,363, West German Patent Application (OLS) Nos. 2,541,274 and 2,541,230, JP-B-53-41091 and EP-A-029104.

In dispersing the oil droplets into a hydrophilic binder, various kinds of surfactants can be used. For instance, the surfactants described in JP-A-59-157639, pp. 37–38, and *Kochi Gijutu*, No. 5, pp. 136–138 (published by Azutec Ltd. in March 22, 1991) can be employed. In addition thereto, the phosphate surfactants disclosed in JP-A-7-56267, JP-A-7-228589, and West German Patent Application (OLS) No. 932,299 A can also be used.

For the hydrophilic binders, water-soluble polymers are suitable. Examples of such a polymer include natural compounds, such as proteins (e.g., gelatin, gelatin derivatives) and polysaccharides (e.g., cellulose derivatives, starch, gum arabic, dextran, pullulan), and synthetic macromolecular compounds, such as polyvinyl alcohol, polyvinyl pyrrolidone and acrylamide polymers. These water-soluble polymers can be used as a combination of two or more thereof. In particular, the combined use of gelatin and another polymer as recited above is preferred. The gelatin can be selected properly depending on various purposes from among lime-processed gelatin, acid-processed gelatin and the so-called delimed gelatin, or gelatin reduced in contents of calcium and the like. These gelatins may be used as mixtures of two or more thereof.

The dyes are decolorized in the presence of a decolorizing agent in the course of processing.

Examples of a decolorizing agent which can be used include alcohols or phenols, amines or anilines, sulfinic acids or salts thereof, sulforous acid and salts thereof, thiosulfuric acid or salts thereof, carboxylic acid and salts thereof, hydrazines, guanidines, aminoguanidines, amidines, thiols, cyclic or chain active methylene compounds, cyclic or chain methine compounds, and the anionic species produced from these compounds.

Of the compounds recited above, hydroxyamines, sulfinic acids, sulfurous acid, guanidines, aminoguanidines, heterocyclic thiols, cyclic or chain active methylene compounds and cyclic or chain methine compounds are preferred over the others. In particular, guanidines and aminoguanidines are used to advantage.

When the decolorizing agent as recited above comes into contact with dye molecules during the processing, the agent is supposed to cause the nucleophilic addition to the dye molecules to effect the decolorization. Preferably, the silver halide photographic material containing dyes and the processing material containing a decolorizing agent or a precursor thereof are brought into face-to-face contact with each other in the presence of water subsequently to or simultaneously with imagewise exposure, and heat is applied thereto. Thereafter, these materials are peeled apart. Thus, colored images are produced in the silver halide photographic material and the dyes are decolorized. Therein, the density of dyes after decolorization is generally reduced to at most one-third, preferably at most one-fifth, its initial density. The amount of the decolorizing agent used is generally from 0.1 to 200 times by mole, preferably from 0.5 to 100 times by mole, that of the dyes used.

The silver halide, color developing agent(s) and coupler (s) may be incorporated in either the same light-sensitive layer or separate light-sensitive layers. In addition to the light-sensitive layers, the present photographic material may be provided with light-insensitive layers, including a protective layer, a subbing layer, interlayers and the foregoing yellow filter and antihalation layers, and further with a backing layer on the back of the support. The total thickness of the coated layers on the light-sensitive layer side is generally from 3 to 25 $\mu$m, preferably from 5 to 20 $\mu$m.

In addition, the present photographic material can contain hardeners, surfactants, photographic stabilizers, antistatic agents, slipping agents, matting agents, latexes, formaldehyde scavengers, dyes and UV absorbents for various purposes. Examples of these additives are described, e.g., in the Research Disclosures as cited above and JP-A-9-204031. Additionally, the antistatic agents preferred in particular are fine grains of metal oxides, such as ZnO, $TiO_2$, $SnO_2$, $Al_2O_3In_2O_3$, $SiO_2$, MgO, BaO, $MoO_3$ and $V_2O_5$.

The supports suitable for the present photographic material are photographic supports described in *Shashin Kogaku no Kiso—Gin-en Shashin Hen* (which means "The Fundamentals of Photographic Engineering—The silver halide photography volume), compiled by Japanese Photographic Society, published by Corona Publisher Co. (1979), pages 223–240. More specifically, films of polyethylene terephthalate, polyethylene naphthalate, polycarbonate, syndiotactic polystyrene, and celluloses (e.g., triacetyl cellulose) are examples thereof.

For the purpose of improving optical and physical characteristics, those support materials are subjected to heat treatment (control of crystallinity and orientation), uniaxial and biaxial stretching (control of orientation), blend with various polymers, and various surface treatments.

Moreover, it is desirable for the present photographic material to utilize the support provided with a magnetic recording layer as disclosed in, e.g., JP-A-4-124645, JP-A-5-40321, JP-A-6-35092 or JP-A-6-31875, thereby recording the information about picture-taking.

On the back of the support, it is also desirable to coat the waterproof polymers as disclosed in JP-A-8-292514.

Details of the polyester supports especially suitable for the photosensitive materials provided with the magnetic recording layers as cited above are described in *Kokai Gihou (Journal of Technical Disclosure),* 94-6023 (issued by the JIII in Mar. 15, 1994).

The support thickness is generally from 5 to 200 $\mu$m, preferably from 40 to 120 $\mu$m.

In the invention, the exposed photographic material is developed with a processing material as a separate material therefrom. The processing material comprises at least a base and/or a precursor thereof. It is most favorable to adopt the processing method as disclosed in EP-A-0210660 or U.S. Pat. No. 4,740,445, wherein the base is produced by the combined use of a slightly water-soluble basic metal compound as a base precursor and a compound capable of undergoing the complexation reaction with the metal ion as a constituent of the basic metal compound in a water medium (referred to as a complexing compound). In this case, it is desirable to add a slightly water-soluble basic metal compound to the photographic material and a complexing compound to the processing material. However, it is also possible to add in the reverse of that way. In the combination advantageous to the invention, fine grains of zinc hydroxide are used in the photographic material, while a picolinate, e.g., guanidine picolinate, is used in the processing material.

The processing material may further contain a mordant. In this case, it is desirable to use a polymeric mordant.

In the processing material, as disclosed in JP-A-9-146246, physical development nuclei, such as colloidal silver and palladium sulfide, and silver halide solvents, such as hydantoin, may be incorporated in advance. In this case, the silver halide in the photographic material undergoes solubilization at the same time as the development to be fixed in the processing material.

Besides the agents as recited above, the processing material may contain a development stop agent and a print-out inhibitor, too.

In analogy with the photographic material, the processing material may have various auxiliary layers, such as a protective layer, a subbing layer and a backing layer.

It is desirable for the processing material to have a processing layer on continuous web and take a form that the processing material is fed from a sending-out roll, used for processing and then wound onto a separate roll without being cut out, as disclosed in JP-A-9-127670.

The processing material has no particular restriction as to the support. Any of the plastic films recited above as support materials usable for the present photographic material, or paper can be used as the support. The support thickness is usually from 4 to 120 $\mu$m, preferably from 6 to 70 $\mu$m.

In addition, the aluminum-deposited film as disclosed in JP-A-9-222690 can also be used as the support.

For developing the present photographic material which has been exposed by means of a camera, it is desirable to adopt the method of superposing the photographic material on the processing material in a condition that the light-sensitive layer faces to the processing layer and the water lies between these layers in an amount ranging from one-tenth to equivalent with the amount required for achieving the maximum of swelling in all the coated layers of those materials, excluding the backing layers, and then heating those materials for a period of 5–60 seconds at a temperature of 60–100° C.

In one way of making water lie between the two materials, either photographic or processing material is dipped in water, and then excess water is removed with a squeegee. In another preferred way, as disclosed in JP-A-10-26817, water is jetted by means of a water applying device comprising a plurality of water-jetting nozzles, which are arranged at regular intervals linearly along the direction crossing the travelling direction of the photographic or processing material, and an actuator displacing the nozzles to the photographic or processing material on the course of travel. In addition, the way of applying water with sponge or the like is also used to advantage.

The heating in the development step can be carried out by contact with a heated block or plate, or by the use of a hot roller, a hot drum or an infrared or far infrared lamp.

The present invention requires no additional bleach-fix step for further removing the silver halide and the developed silver remaining in the photographic material after development. With the intention of reducing a load for reading image information and enhancing the image stability, however, the fix and/or bleach step may be carried out. Although such step(s) may be performed by usual liquid treatment, it is preferable that the step(s) be performed by subjecting the photographic material to heat treatment together with the other sheet coated with the processing agent(s) as disclosed in JP-A-9-258402.

After forming images in the present photographic material, the production of color images in another recording material is carried out on the basis of information from the images formed. Although the color image production may be performed using a photosensitive material like color paper and usual projection exposure, it is preferable to adopt the method of photoelectrically reading the image information by density measurement of transmitted light, converting to digital signals, subjecting the signals to image processing, and outputting the processed signals to another recording material. Besides the silver halide-utilized photosensitive materials, the output materials may be sublimation type heat-sensitive recording materials, full-color direct heat-sensitive recording materials, ink jet recording materials or electrophotographic materials.

The present invention will now be illustrated in greater detail by reference to the following examples. However, the invention should not be construed as being limited to these examples.

EXAMPLE 1

(1) Preparation of Emulsions

Tabular Silver Iodobromide Emulsion 1-A (Comparative Emulsion)

(Process 1)

In accordance with a double jet method, 96 ml of a 0.1 M aqueous silver nitrate solution and 50 ml of a 0.2 M aqueous potassium bromide solution were added simultaneously to 1,200 ml of a water solution containing 1 g of low molecular weight gelatin (molecular weight: 15,000) and 0.3 g of potassium bromide over a 20-second period with stirring as the temperature was kept at 30° C. Thereto, 38.0 g of gelatin (lime-processed gelatin) was added. The resulting solution was adjusted to pAg 10.76, heated up to 75° C. over a period of 26 minutes, and then ripened for 20 minutes. Further, 302 ml of a 1.9 M aqueous silver nitrate solution and a 2.2 M aqueous potassium bromide solution containing 5 mole % of potassium iodide were added simultaneously at increasing flow rates over a 55-minute period (wherein their respective flow rates at the end of addition were 10 times those at the beginning of the addition) as the pAg was kept at 7.72. Furthermore, 96 ml of a 1.9 M aqueous silver nitrate solution and 80 ml of a 1.8 M aqueous potassium bromide solution were added simultaneously at respectively constant flow rates over a period of 10 minutes while keeping the pAg at 8.01.

(Process 2)

After the addition was completed, the reaction solution was cooled to 40° C., and thereto a water solution containing 19 g of sodium p-iodoacetamidobenzenesulfonate as iodide ion releasing agent was added. Then, 77 ml of a 0.8 M aqueous sodium sulfite solution was added over a 1-minute period at a constant flow rate to raise the pH to 9. By keeping the pH at 9, the iodide ion was produced therein. After a two-minute lapse, the temperature of the solution was raised up to 55° C. over a 5-minute period, and then the pH was returned to 5.5. Thereafter, sodium benzenethiosulfonate and $K_2IrCl_6$ were added in amounts of $3.8\times10^{-6}$ mole and $4\times10^{-8}$ mole respectively per mole of total silver in individual grains. Thereto were further added 269 ml of a 1.5 M aqueous silver nitrate solution and a 1.8 M aqueous potassium bromide solution containing potassium hexacyanoferrate (II) in the amount of $2\times10^{-5}$ mole per mole of total silver in individual grains at constant flow rates over a period of 20 minutes while keeping the pAg at 8.59.

(Process 3)

After cooling to 35° C., the emulsion obtained was washed using a conventional flocculation method, and thereto an aqueous solution containing zinc nitrate was added in the amount of $1\times10^{-3}$ mole per mole of total grain in individual grains. Then, the emulsion was raised in pH, and thereto 75 g of gelatin was added and dispersed, and further adjusted to pH 5.8 and pAg 8.2. The thus obtained emulsion (hereinafter referred to as Emulsion 1-A) was stored.

In the emulsion obtained, the tabular grains accounted for more than 98% of the total grains on a projected area basis, and the hexagonal tabular grains having an average equivalent diameter of 0.78 μm and a ratio of adjacent sides (a longest side/shortest side ratio) in the range of 1.5 to 1 comprised more than 90% of the total grains on a projected area basis (the same hexagonal tabular grains as mentioned above were comprised in Emulsions 1-B to 1-D described below, too).

The average grain thickness of the total tabular grains was 0.22 μm and the average aspect ratio of the total tabular grains was 5.5. The variation coefficient was 13% with respect to the distribution of projected area diameters among the total tabular grains. The crystal shapes of the emulsion grains obtained were determined by taking transmission electron photomicrographs thereof and examining them in accordance with the replica method.

Further, the observation of the emulsion grains under a high voltage electron microscope (accelerating voltage: 400 kV) was carried out in the manner described hereinbefore. Therein, 200 grains picked out of the emulsion grains were examined for dislocation lines (the location at which they were introduced, and their density and distribution). Additionally, the observation of each grain was made at 5 angles of sample inclinations, namely at angles of −10°, −5°, 0°, +5° and +10°. By these observations, it was confirmed that the proportion of tabular grains having at least 10 dislocation lines per grain in the fringe part was at least 80% of the total grains on a number basis and the proportion of tabular grains the dislocation lines of which were located substantially in the fringe part alone was also at least 80% of the total grains on a number basis (These were the same in the cases of Emulsions 1-B to 1-D described below).

Furthermore, by the use of an X-ray microanalyzer, 200 grains picked out of the emulsion grains were examined for silver iodide content in the manner as described hereinbefore. The variation coefficient concerning the distribution of silver iodide contents among the grains was not greater than 15% (This was also the same in the cases of Emulsions 1-B to 1-D described below).

Tabular Silver Iodobromide Emulsion 1-B (Present Emulsion)

Another emulsion was prepared in the same manner as Emulsion 1-A, except that the process 1 was altered as follows: Instead of simultaneously adding 302 ml of a 1.9 M aqueous silver nitrate solution and a 2.2 M aqueous potassium bromide solution containing 5 mole % of potassium iodide at increasing flow rates as the pAg was kept at 7.72, 302 ml of a 1.9 M aqueous silver nitrate solution and a 2.2 M aqueous potassium bromide solution containing 1 mole % of potassium iodide were added simultaneously at increasing flow rates as the pAg was kept at 8.01.

As to the grain shapes of the emulsion grains obtained, it was confirmed that the tabular grains having their aspect ratios in the range of 4 to 50 accounted for at least 80% of the total grains on a projected area basis, the average thickness of the total tabular grains was 0.18 μm, the average aspect ratio of the total tabular grains was 7.4 and the variation coefficient was 14% with respect to the distribution of projected area diameter among the total tabular grains.

Tabular Silver Iodobromide Emulsion 1-C (Present Emulsion)

Still another emulsion was prepared in the same manner as Emulsion 1-A, except that there was the following two alterations in the process 1: The addition of 38 g of gelatin (lime-processed gelatin) was changed to the addition of 45 g of trimellitic acid-processed gelatin, and the simultaneous addition of 302 ml of a 1.9 M aqueous silver nitrate solution and a 2.2 M aqueous potassium bromide solution containing 5 mole % of potassium iodide at increasing flow rates while keeping the pAg at 7.72 was replaced by the simultaneous addition of 302 ml of a 1.9 M aqueous silver nitrate solution and a 2.2 M aqueous potassium bromide solution containing 1 mole % of potassium iodide at increasing flow rates while keeping the pAg at 8.01.

As to the grain shapes of the emulsion grains obtained, it was confirmed that the tabular grains having their aspect ratios in the range of 6 to 50 accounted for at least 80% of the total grains on a projected area basis, the average thickness of the total tabular grains was 0.13 μm, the average aspect ratio of the total tabular grains was 12.0 and the variation coefficient was 15% with respect to the distribution of projected area diameter among the total tabular grains.

Tabular Silver Iodobromide Emulsion 1-D (Present Emulsion)

A further emulsion was prepared in the same manner as Emulsion 1-C, except that the process 1 was altered as follows: Instead of keeping the pAg at 8.01 during the simultaneous addition of 302 ml of a 1.9 M aqueous silver nitrate solution and a 2.2 M aqueous potassium bromide solution containing 1 mole % of potassium iodide at increasing flow rates, the pAg was kept at 8.58.

As to the grain shapes of the emulsion grains obtained, it was confirmed that the tabular grains having their aspect ratios in the range of 8 to 50 accounted for at least 80% of the total grains on a projected area basis, the average thickness of the total tabular grains was 0.08 $\mu$m, the average aspect ratio of the total tabular grains was 24.7 and the variation coefficient was 20% with respect to the distribution of projected area diameter among the total tabular grains.

(2) Chemical Sensitization

While keeping the temperature at 56° C., the pH at 5.6 and the pAg at 8.4, each of Emulsions 1-A to 1-D was spectrally sensitized by the addition of the following Sensitizing Dyes I, II and III in the case of conferring the red sensitivity to the emulsion, Sensitizing dye IV, V and VI in the case of conferring the green sensitivity to the emulsion, or Sensitizing Dye VII in the case of conferring the blue sensitivity to the emulsion, and then chemically sensitized by sequential addition of a solution of potassium thiocyanate/chloroauric acid mixture, sodium thiosulfate, the following selenium sensitizer and Compound I. The amounts of the sensitizing dyes added and those of the chemical sensitizers added were each adjusted so that the emulsion obtained achieved the maximum sensitivity under the 1/100 second exposure. The term sensitivity as used herein is defined as the logarithmic value of the reciprocal of an exposure amount providing the density of fog+0.15 on the characteristic curve obtained by performing the exposure and development operations described below. As shown in the following Tables, the letter b, g or r is attached to the symbol of each of the emulsions prepared depending on the sensitizing dye(s) used therein.

Sensitizing Dye I for red-sensitive emulsion

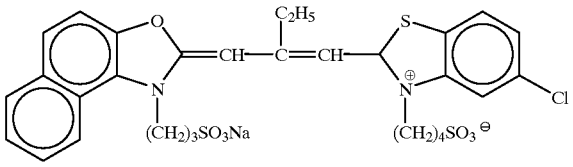

Sensitizing Dye II for red-sensitive emulsion

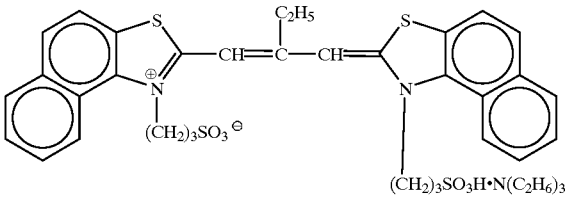

-continued

Sensitizing Dye III for red-sensitive emulsion

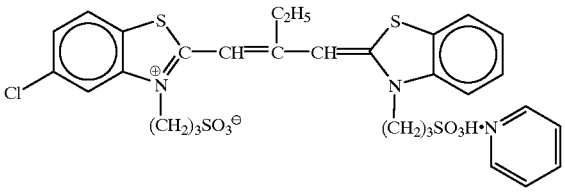

Mixing ratio of Sensitizing Dyes I, II and III=40:2:58 by mole.

Sensitizing Dye IV for green-sensitive emulsion

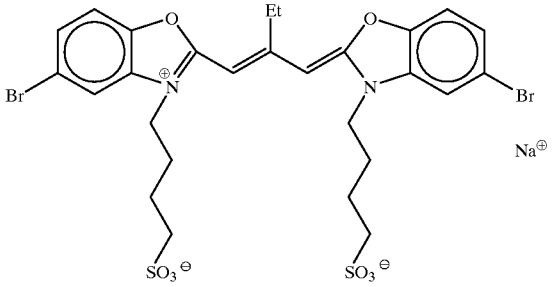

Sensitizing Dye VI for green-sensitive emulsion

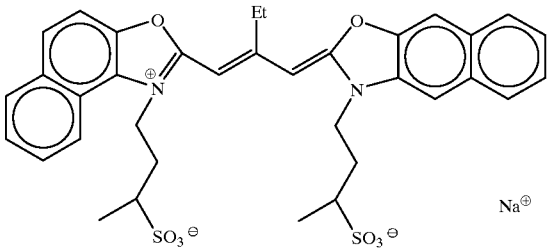

Sensitizing Dye VI for green-sensitive emulsion

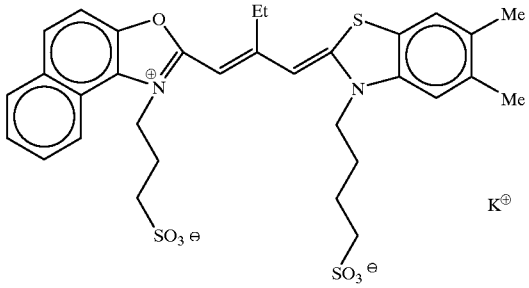

Mixing ratio of Sensitizing Dyes IV, V and VI=77:20:3 by mole.

Sensitizing Dye VII for blue-sensitive emulsion

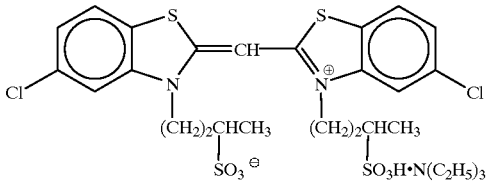

-continued

Compound I

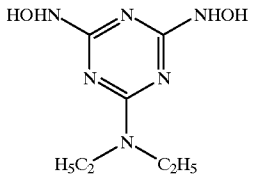

Selenium Sensitizer

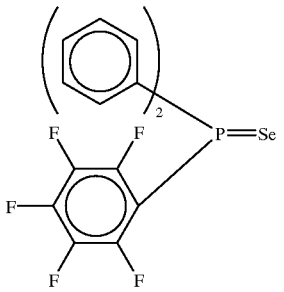

Mercapto Compound

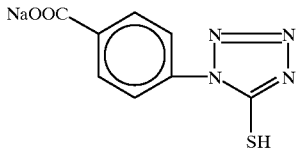

(3) Preparation of Dispersions and Coated Samples, and Evaluations thereof

<Preparation of Zinc Hydroxide Dispersion (for 5th and 12th layers>

A dispersion of zinc hydroxide used as base precursor was prepared in the following manner:

A zinc hydroxide powder, the primary grains of which had a size of 0.2 $\mu$m, in an amount of 31 g was mixed with 1.6 g of carboxymethyl cellulose as a dispersant, 0.4 g of sodium polyacrylate, 8.5 g of lime-processed ossein gelatin and 158.5 ml of water, and the mixture obtained was dispersed for 1 hour with a mill using glass beads. After the dispersion was completed, the glass beads were filtered out. Thus, 188 g of the zinc hydroxide dispersion was obtained.

<Preparation of Emulsified Dispersions Containing Developing Agent(s) and Coupler(s)>

(i) Emulsified Dispersion Containing Developing Agents and Yellow Coupler

A mixture of 10 g of Yellow Coupler YC-(1), 8.2 g of Developing Agent (1), 1.6 g of Developing Agent (2), 21 g of high boiling organic Solvent (1) and 50.0 ml of ethyl acetate was made into a solution by heating at 60° C. This solution (Solution II) and 170 g of a water solution containing 12.0 g of lime-processed gelatin and 1 g of Surfactant (1) (Solution I) were mixed, and emulsified into dispersion over a 20-minute period by using a Dissolver stirrer at 10,000 r.p.m. To the dispersion obtained, distilled water was added in an amount to make the total weight 300 g, and mixed for 10 minutes at 2,000 r.p.m.

Yellow Coupler YC-(1)

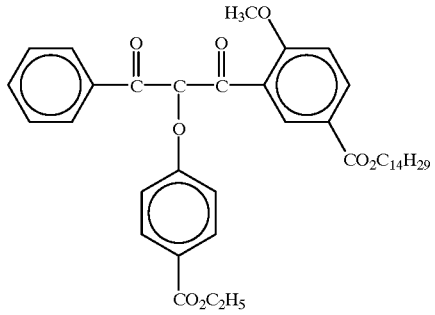

Developing Agent (1)

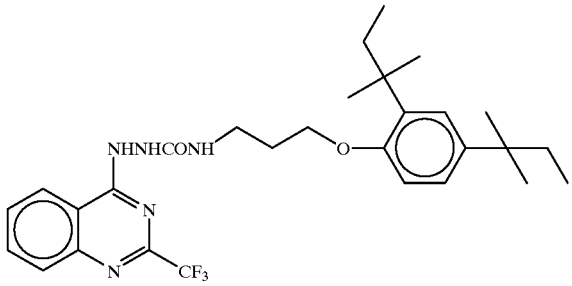

Developing Agent (2)

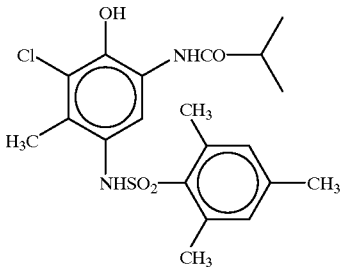

High Boiling Organic Solvent (1)

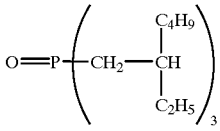

Surfactant (1)

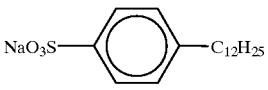

(ii) Emulsified Dispersion Containing Developing Agents and Magenta Couplers

A mixture of 7. 5 g of Magenta Coupler MC- (1), 7.5 g of Magenta Coupler MC- (2), 8.2 g of Developing Agent (3), 1.05 g of Developing Agent (2), 11 g of high boiling organic Solvent (1) and 24.0 ml of ethyl acetate was made into a solution by heating at 60° C. (Solution II). Solution II and 170 g of a water solution containing 12 g of lime-processed gelatin and 1 g of Surfactant (1) (Solution I) were mixed, and emulsified into dispersion over a 20-minute period by using a Dissolver stirrer at 10,000 r.p.m. To the dispersion obtained, distilled water was added in an amount to make the total weight 300 g, and mixed for 10 minutes at 2,000 r.p.m.

Magenta Coupler MC-(1)

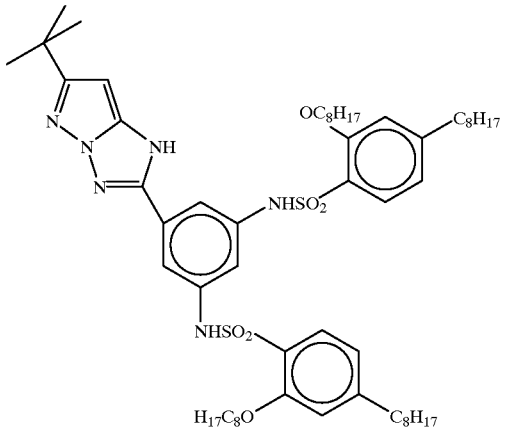

Magenta coupler MC-(2)

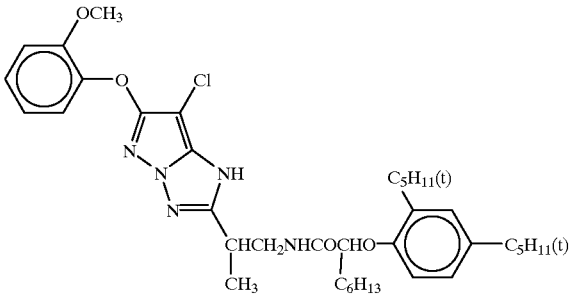

Developing Agent (3)

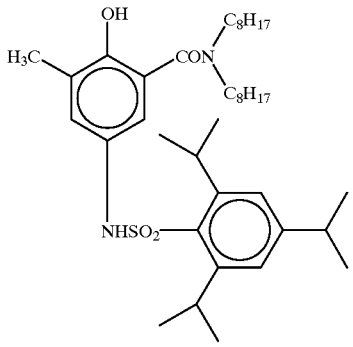

(iii) Emulsified Dispersion Containing Developing Agents and Cyan Coupler

A mixture of 10.7 g of Cyan Coupler CC-(1), 8.2 g of Developing Agent (3), 1.05 g of Developing Agent (2), 11 g of high boiling organic Solvent (1) and 24.0 ml of ethyl acetate was made into a solution by heating at 60° C. This solution (Solution II) and 170 g of a water solution containing 12 g of lime-processed gelatin and 1 g of Surfactant (1) (Solution I) were mixed, and emulsified into dispersion over a 20-minute period by using a Dissolver stirrer at 10,000 r.p.m. To the dispersion obtained, distilled water was added in an amount to make the total weight 300 g, and mixed for 10 minutes at 2,000 r.p.m.

Cyan Coupler CC-(1)

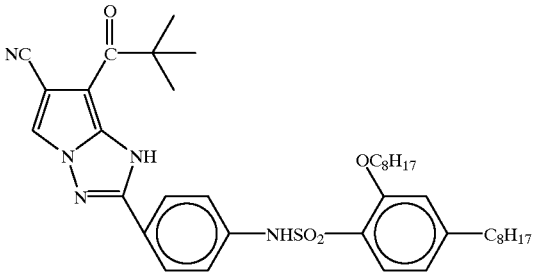

<Preparation of Dye Dispersions for Yellow Filter, Magenta Filter and Antihalation Layers>

(i) Dye Dispersion for Yellow Filter Layer

Ethyl acetate was added to a mixture of 14 g of YF-1 and 13 g of high boiling organic Solvent (2), and made into a homogeneous solution by heating to about 60° C. To 100 ml of this solution, 1.0 g of Surfactant (1) and 190 ml of a 6.6% aqueous lime-processed gelatin solution previously heated to about 60° C. were added, and dispersed for 10 minutes by using a homogenizer at 10,000 r.p.m.

(ii) Dye Dispersion for Magenta Filter Layer

Ethyl acetate was added to a mixture of 13 g of MF-1 and 13 g of high boiling organic Solvent (2), and made into a homogeneous solution by heating to about 60° C. To 100 ml of this solution, 1.0 g of Surfactant (1) and 190 ml of a 6.6% aqueous lime-processed gelatin solution previously heated to about 60° C. were added, and dispersed for 10 minutes by using a homogenizer at 10,000 r.p.m.

(iii) Dye Dispersion for Antihalation Layer

Ethyl acetate was added to a mixture of 20 g of CF-1 and 15 g of high boiling organic Solvent (1), and made into a homogeneous solution by heating to about 60° C. To 100 ml of this solution, 1.0 g of Surfactant (1) and 190 ml of a 6.6% aqueous lime-processed gelatin solution previously heated to about 60° C. were added, and dispersed for 10 minutes by using a homogenizer at 10,000 r.p.m.

YF-1

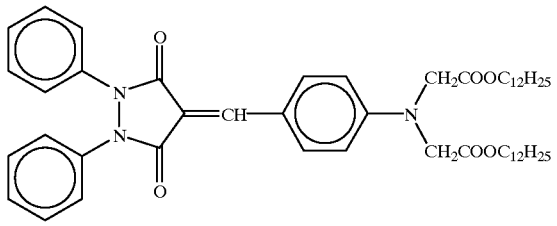

MF-1

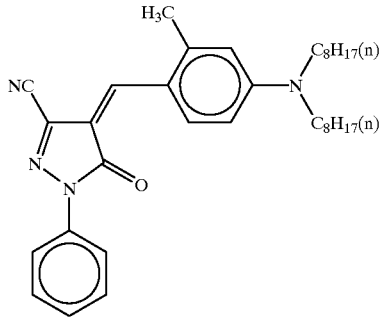

-continued

CF-1

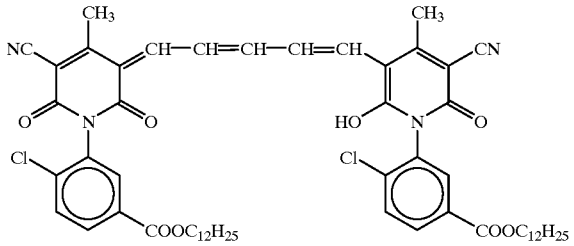

High Boiling Organic Solvent (2)

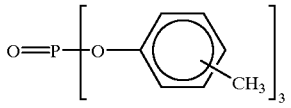

Those dispersions and the silver halide Emulsions 1-Ar, 1-Ag and 1-Ab prepared above were incorporated in the highest speed emulsion layers of red-sensitive (cyan color forming layers), green-sensitive (magenta color forming layers) and blue-sensitive (yellow color forming layers) emulsion layers respectively so as to provide the compositions set forth in Table 1. And the coating compositions for the constituent layers shown in Table 1 were coated on a support to prepare a multi-layer color photographic material, Sample No. 101. Further, multi-layer color photographic materials, Sample Nos. 102 to 116, were prepared by using the silver halide emulsions shown in Table 2 in place of Emulsions 1-Ar, 1-Ag and 1-Ab, and that respectively changed coverage rates, thereby changing the total silver coverage of each Sample. Additionally, the samples thus prepared were stored for 7 days under the condition of 25° C.-65% RH, and then cut out.

TABLE 1

Photographic Material (Sample No. 101)

| Layer Structure | Ingredients added | Amount added ($mg/m^2$) |
|---|---|---|
| 13th Layer Protective layer | Lime-processed gelatin | 904 |
| | Matting agent (silica) | 38 |
| | Surfactant (5) | 30 |
| | Surfactant (3) | 25 |
| | Water-soluble polymer (1) | 20 |
| | Hardener (1) | 104 |
| 12th Layer Interlayer | Lime-processed gelatin | 760 |
| | Surfactant (3) | 10 |
| | Zinc hydroxide | 341 |
| | Water-soluble polymer (1) | 30 |
| 11th Layer Yellow color forming layer (High speed layer) | Lime-processed gelatin | 560 |
| | Emulsion I-Ab (Sensitizing Dye VII) | 750 (based on silver coverage) |
| | Antifoggant (1) | 1.6 |
| | Yellow Coupler YC-(1) | 228 |
| | Developing agent (1) | 185 |
| | Developing agent (2) | 38 |
| | Surfactant (1) | 26 |
| | High boiling organic solvent (1) | 156 |
| | Water-soluble polymer (1) | 15 |
| 10th Layer Yellow color forming layer (Low speed layer) | Lime-processed gelatin | 560 |
| | Emulsion C (Sensitizing Dye VII) | 370 (based on silver coverage) |
| | Emulsion D (Sensitizing Dye VII) | 230 (based on silver coverage) |
| | Antifoggant (1) | 3.92 |
| | Yellow Coupler YC-(1) | 357 |
| | Developing agent (1) | 290 |

TABLE 1-continued

Photographic Material (Sample No. 101)

| Layer Structure | Ingredients added | Amount added ($mg/m^2$) |
|---|---|---|
| | Developing agent (2) | 59 |
| | Surfactant (1) | 42 |
| | High boiling organic solvent (1) | 476 |
| | Water-soluble polymer (1) | 43 |
| 9th Layer Interlayer (Yellow filter) | Lime-processed gelatin | 1000 |
| | Yellow Dye YF-1 | 140 |
| | High boiling organic solvent (2) | 130 |
| | Surfactant (1) | 15 |
| | Water-soluble polymer (1) | 17 |
| 8th Layer Magenta color forming layer (High speed layer) | Lime-processed gelatin | 496 |
| | Emulsion I-Ag (Sensitizing Dyes IV, V, VI) | 1082 (based on silver coverage) |
| | Antifoggant (1) | 1.87 |
| | Magenta Coupler MC-(1) | 62 |
| | Magenta Coupler MC-(2) | 8 |
| | Developing agent (3) | 68 |
| | Developing agent (2) | 8.7 |
| | Surfactant (1) | 6.5 |
| | High boiling organic solvent (1) | 78 |
| | Water-soluble polymer (1) | 28 |
| 7th Layer Magenta color forming layer (Medium speed layer) | Lime-processed gelatin | 551 |
| | Emulsion A (Sensitizing Dyes IV, V, VI) | 346 (based on silver coverage) |
| | Antifoggant (1) | 1.54 |
| | Magenta Coupler MC-(1) | 100 |
| | Magenta Coupler MC-(2) | 15 |
| | Developing agent (3) | 109 |
| | Developing agent (2) | 14 |
| | Surfactant (1) | 33 |
| | High boiling organic solvent (1) | 101 |
| | Water-soluble polymer (1) | 23 |
| 6th Layer Magenta color forming layer (Low speed layer) | Lime-processed gelatin | 665 |
| | Emulsion B (Sensitizing Dyes IV, V, VI) | 300 (based on silver coverage) |
| | Antifoggant (1) | 1.27 |
| | Magenta Coupler MC-(1) | 274 |
| | Magenta Coupler MC-(2) | 36.5 |
| | Developing agent (3) | 300 |
| | Developing agent (2) | 38.5 |
| | Surfactant (1) | 33 |
| | High boiling organic solvent (1) | 272 |
| | Water-soluble polymer (1) | 26 |
| 5th Layer Interlayer (Magenta filter) | Lime-processed gelatin | 871 |
| | Magenta Dye MF-1 | 150 |
| | High boiling organic solvent (2) | 25 |
| | Zinc hydroxide | 2030 |
| | Surfactant (1) | 115 |
| | Water-soluble polymer (1) | 44 |
| 4th Layer Cyan color forming layer (High speed layer) | Lime-processed gelatin | 1000 |
| | Emulsion I-Ar (Sensitizing Dyes I, II, III) | 1490 (based on silver coverage) |
| | Antifoggant (1) | 0.85 |
| | Magenta Coupler CC-(1) | 189 |
| | Developing agent (3) | 145 |
| | Developing agent (2) | 18.5 |
| | Surfactant (1) | 15 |
| | High boiling organic solvent (1) | 26 |
| | Water-soluble polymer (1) | 16 |
| 3rd Layer Cyan color | Lime-processed gelatin | 292 |
| | Emulsion A (Sensitizing | 391 (based |

TABLE 1-continued

| Photographic Material (Sample No. 101) | | |
|---|---|---|
| Layer Structure | Ingredients added | Amount added (mg/m$^2$) |
| forming layer (Medium speed layer) | Dyes I, II, III) | silver coverage) |
| | Antifoggant (1) | 2.04 |
| | Magenta Coupler CC-(1) | 90 |
| | Developing agent (3) | 69 |
| | Developing agent (2) | 8.8 |
| | Surfactant (1) | 7 |
| | High boiling organic solvent (1) | 104 |
| | Water-soluble polymer (1) | 18 |
| 2nd Layer Cyan color forming layer (Low speed layer) | Lime-processed gelatin | 730 |
| | Emulsion B (Sensitizing Dyes I, II, III) | 321 (based silver coverage) |
| | Antifoggant (1) | 3.34 |
| | Magenta Coupler CC-(1) | 232 |
| | Developing agent (1) | 178 |
| | Developing agent (2) | 23 |
| | Surfactant (1) | 17 |
| | High boiling organic solvent (1) | 173 |
| | Water-soluble polymer (1) | 32 |
| 1st Layer Interlayer (Antihalation) | Lime-processed gelatin | 429 |
| | cyan Dye CF-1 | 132 |
| | High boiling organic solvent (2) | 212 |
| | Surfactant (1) | 17 |
| | Water-soluble polymer (1) | 24 |
| Transparent PET base (120 μm) having gelatin undercoat on both sides | | |
| Antistatic Layer | Lime-processed gelatin (molecular weight: 12,000) | 60 |
| | Fine grains of tin oxide-antimony oxide compound having average grain size of 0.005 μm (secondary condensed grain diameter: about 0.08 μm, specific resistance: 5 · •cm$^2$) | 180 |
| | Polyethylene-p-nonylphenol (polymerization degree: 10) | 5 |
| Second Backing Layer | Lime-processed gelatin (molecular weight: 12,000) | 2000 |
| | Surfactant (3) | 11 |
| | PMMA latex (diameter: 6 μm) | 9 |
| | Hardener (2) | 455 |
| Third Backing Layer | Copolymer of methyl methacrylate, styrene 2-ethylhexylacrylate and methacrylic acid | 1000 |
| | Surfactant (3) | 1.5 |
| | Surfactant (4) | 20 |
| | Surfactant (5) | 2.5 |

TABLE 2

| | Yellow color forming high speed layer (11th layer) | | Magenta color forming high speed layer (8th layer) | | Cyan color forming high speed layer (4th layer) | |
|---|---|---|---|---|---|---|
| Sample No. | Emulsion symbol | Silver coverage | Emulsion symbol | Silver coverage | Emulsion symbol | Silver coverage |
| 101 | 1-Ab | 750 | 1-Ag | 1082 | 1-Ar | 1490 |
| 102 | 1-Bb | 750 | 1-Bg | 1082 | 1-Br | 1490 |
| 103 | 1-Cb | 750 | 1-Cg | 1082 | 1-Cr | 1490 |
| 104 | 1-Db | 750 | 1-Dg | 1082 | 1-Dr | 1490 |
| 105 | 1-Ab | 615 | 1-Ag | 887 | 1-Ar | 1222 |
| 106 | 1-Bb | 615 | 1-Bg | 887 | 1-Br | 1222 |
| 107 | 1-Cb | 615 | 1-Cg | 887 | 1-Cr | 1222 |
| 108 | 1-Db | 615 | 1-Dg | 887 | 1-Dr | 1222 |
| 109 | 1-Ab | 390 | 1-Ag | 563 | 1-Ar | 775 |
| 110 | 1-Bb | 390 | 1-Bg | 563 | 1-Br | 775 |
| 111 | 1-Cb | 390 | 1-Cg | 563 | 1-Cr | 775 |
| 112 | 1-Db | 390 | 1-Dg | 563 | 1-Dr | 775 |
| 113 | 1-Ab | 188 | 1-Ag | 271 | 1-Ar | 373 |
| 114 | 1-Bb | 188 | 1-Bg | 271 | 1-Br | 373 |
| 115 | 1-Cb | 188 | 1-Cg | 271 | 1-Cr | 373 |
| 116 | 1-Db | 188 | 1-Dg | 271 | 1-Dr | 373 |

Unit of silver coverage: mg/m$^2$

TABLE 2-continued
Surfactant (2)
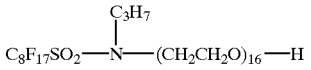
Surfactant (3)
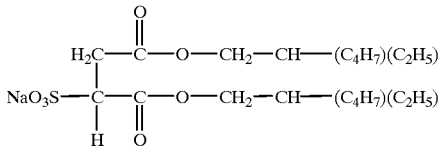
Surfactant (4)
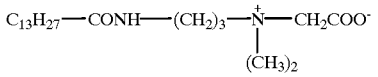
Surfactant (5)
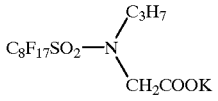
Water-soluble polymer (1)
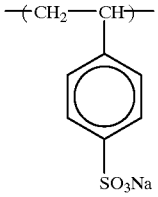
Hardener (1)
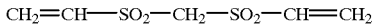
Hardener (2)
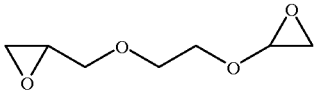
Antifoggant (1)
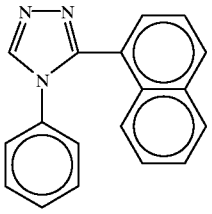

The Emulsions A to D used above are shown in Table 3.

TABLE 3

| | Average AgI content (mole %) | Average equivalent diameter of grains (μm) | Variation coefficient concerning grain size (%) | Diameter/ thickness ratio | Silver content ratio [core/middle/shell] AgI content ratio in parentheses | Shape and structure of grains |
|---|---|---|---|---|---|---|
| Emulsion A | 5.4 | 0.65 | 20 | 5.4 | 14/55/31 (0/2/13) | Triply layered tabular grains |
| Emulsion B | 3.7 | 0.49 | 15 | 3.2 | 7/32/61 (5/0/5) | Triply layered tabular grains |
| Emulsion C | 7.2 | 0.50 | 22 | 4.3 | 17/37/46 (1/7/10) | Triply layered tabular grains |
| Emulsion D | 3.7 | 0.43 | 16 | 4.6 | 5/54/41 (0/0/9) | Triply layered tabular grains |

Then, Processing Materials P-1 and P-2 as shown in Table 4 and 5 respectively were prepared.

TABLE 4

Processing Material P-1

| Layer structure | Ingredients added | Amount added (mg/m$^2$) |
|---|---|---|
| Fourth layer (Protective layer) | Lime-processed gelatin | 220 |
| | Water-soluble polymer (2) | 60 |
| | Water-soluble polymer (3) | 200 |
| | Potassium nitrate | 12 |
| | PMMA latex (diameter: 6 μm) | 10 |
| | Surfactant (3) | 7 |
| | Surfactant (4) | 7 |
| | Surfactant (5) | 10 |
| Third layer (Interlayer) | Lime-processed gelatin | 240 |
| | Water-soluble polymer (2) | 24 |
| | Hardener (2) | 180 |
| | Surfactant (3) | 9 |
| Second layer (Base producing layer) | Lime-processed gelatin | 2400 |
| | Water-soluble polymer (3) | 360 |
| | Water-soluble polymer (4) | 700 |
| | Water-soluble polymer (5) | 1000 |
| | Guanidine picolinate | 2910 |
| | Potassium quinolinate | 225 |
| | Sodium quinolinate | 180 |
| | Surfactant (3) | 24 |
| First layer Interlayer (Subbing layer) | Lime-processed gelatin | 280 |
| | Water-soluble polymer (2) | 12 |
| | Surfactant (3) | 14 |
| | Hardener (2) | 185 |
| | Transparent support A (45 μm) | |

Constitution of Support A

| Layer Name | Composition | Amount added (mg/m$^2$) |
|---|---|---|
| Subbing layer on the front | Lime-processed gelatin | 100 |
| Polymer layer | Polyethylene terephthalate | 62500 |
| Subbing layer on the back | Copolymer of methyl methacrylate, styrene, 2-ethylhexylacrylate and methacrylic acid | 1000 |
| | PMMA latex | 120 |

TABLE 5

Processing Material P-2

| Layer structure | Ingredients added | Amount added (mg/m$^2$) |
|---|---|---|
| Fourth layer (Protective layer) | Lime-processed gelatin | 220 |
| | Water-soluble polymer (2) | 60 |
| | Water-soluble polymer (3) | 200 |
| | Potassium nitrate | 12 |
| | PMMA latex (diameter: 6 μm) | 10 |
| | Surfactant (3) | 7 |
| | Surfactant (4) | 7 |
| | Surfactant (5) | 10 |
| Third layer (Interlayer) | Lime-processed gelatin | 240 |
| | Water-soluble polymer (2) | 24 |
| | Hardener (2) | 180 |
| | Surfactant (3) | 9 |
| Second layer (Fixed layer) | Lime-processed gelatin | 2400 |
| | Silver halide solvent (1) | 5500 |
| | Water-soluble polymer (5) | 2000 |
| | Surfactant (3) | 24 |
| First layer Interlayer (Subbing layer) | Lime-processed gelatin | 280 |
| | Water-soluble polymer (2) | 12 |
| | Surfactant (3) | 14 |
| | Hardener (2) | 185 |
| Transparent Support A (43 μm) (the same as the support of P-1) | | |

Water-soluble Polymer (2):

κ-Carrageenan

Water-soluble Polymer (3):

Sumikagel L-5H (trade name, a product of Sumitomo Chemical Co., Ltd.)

Water-soluble Polymer (4):

Dextrane (molecular weight: 70,000)

Water-soluble Polymer (5):

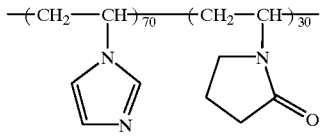

Silver Halide solvent (1)

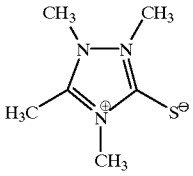

<Evaluation>

The photographic materials, Sample Nos. 101 to 116, were exposed under the illuminance of 1,000 lx for 1/100 second via an optical wedge. Then, 40° C. water was applied to the exposed sample surface at a coverage of 15 ml/m$^2$. These water-applied samples were brought into face-to-face contact with the processing material P-1, and then underwent 17-second heat development at 83° C. by means of a heat drum. The samples thus developed were separated from P-1, and wedge-shaped images of a developed gray color were produced therein. When the samples were exposed via a blue filter, they produced wedge-shaped images of a developed yellow color; when they were exposed via a green filter, they produced wedge-shaped images of a developed magenta color; and when they were exposed via a red filter, they produced wedge-shaped images of a developed cyan color.

The samples in developed gray color were subjected to the second processing step with Processing Material P-2 (fixation processing). In the second processing step, the samples after heat development was coated with 10 cc/m$^2$ of water on the surface side, and brought into face-to-face contact with the Processing Material P-2, followed by 30-second heating at 60° C.

The transmission densities of each of the thus obtained samples of developed colors were measured via blue, green and red filters respectively, and thereby the so-called characteristic curves were made. The logarithmic value of the reciprocal of the exposure amount providing the density of fog+0.15, which was determined with the characteristic curve of each developed color, was referred to as relative sensitivity. The mean value of relative sensitivities of three developed colors was calculated for each sample, and defined as the sensitivity of each sample. The sensitivity values set forth in Table 6 are relative values, with Sample No. 101 being taken as 100.

Further, the gradation (gamma value) was also determined with the characteristic curves of three developed colors in the following way: The gradient of a straight line connecting two points corresponding to the density of fog+0.1 and the density of fog+0.8 respectively on the characteristic curve of each developed color was referred to as relative gamma value. The mean value of relative gamma values of three developed colors was calculated for each sample, and defined as the gamma value of each sample. The gamma values set forth in Table 6 are also relative values, with Sample No. 101 being taken as 100.

For comparing the present heat development with a conventional liquid development, on the other hand, the same samples as prepared above were subjected to exposure under the same conditions as described above, and developed with a standard developer for color negative film, CN-16, made by Fuji Photo film Co., Ltd., at 38° C. for 185 seconds. The thus processed samples were also examined for sensitivity and gamma values in the same ways as mentioned above. The sensitivity and gamma values set forth in Table 6 are also relative values, with Sample No. 101 being taken as 100.

TABLE 6

| Sample No. | Total silver coverage (g/m$^2$) | Average thickness of total tabular grains in emulsion used for each of highest speed blue-, green- and red-sensitive layers | Heat development Sensitivity | Heat development Gamma | CN-16 liquid development Sensitivity | CN-16 liquid development Gamma | Note |
|---|---|---|---|---|---|---|---|
| 101 | 5.3 | 0.22 | 100 | 100 | 100 | 100 | comparison |
| 102 | 5.3 | 0.18 | 112 | 91 | 110 | 93 | domparison |
| 103 | 5.3 | 0.13 | 138 | 90 | 132 | 91 | comparison |
| 104 | 5.3 | 0.08 | 162 | 88 | 155 | 88 | comparison |
| 105 | 4.7 | 0.22 | 93 | 96 | 93 | 95 | comparison |
| 106 | 4.7 | 0.18 | 110 | 103 | 102 | 100 | invention |
| 107 | 4.7 | 0.13 | 135 | 108 | 120 | 103 | invention |
| 108 | 4.7 | 0.08 | 155 | 112 | 138 | 103 | invention |
| 109 | 3.7 | 0.22 | 83 | 88 | 81 | 86 | comparison |
| 110 | 3.7 | 0.18 | 105 | 100 | 91 | 88 | invention |
| 111 | 3.7 | 0.13 | 126 | 105 | 105 | 90 | invention |
| 112 | 3.7 | 0.08 | 145 | 109 | 120 | 92 | invention |
| 113 | 2.8 | 0.22 | 66 | 74 | 63 | 71 | comparison |
| 114 | 2.8 | 0.18 | 93 | 95 | 71 | 73 | invention |
| 115 | 2.8 | 0.13 | 107 | 100 | 81 | 75 | invention |
| 116 | 2.8 | 0.08 | 120 | 103 | 93 | 76 | invention |

As can be seen from Table 6, both sensitivity drop and soft gradation enhancement were caused markedly in the photographic materials having the total silver coverage not more than 5 g/m$^2$ but not containing tabular silver halide emulsions having the average grain thickness of not larger than 0.20 $\mu$m. On the other hand, the use of the present emulsions has proved to produce significant improvements on these points in the case of heat development. Further, it was found that even when the present tabular emulsions were used, the soft gradation enhancement was caused to a considerable extent so far as the total silver coverage was increased beyond 5 g/m$^2$. The achievement of those improving effects was characteristic of the system wherein the developing agent-incorporated photographic materials were subjected to heat development, and these embodiments of the invention could not be expected from conventional arts. In accordance with the invention, photographic color photographic materials can provide high sensitivity and appropriate gradation even when they have reduced total silver coverage and undergo simple and rapid processing with a reduced load on environments.

EXAMPLE 2

Photographic material samples were produced in the same manner as in Example 1, except that the transparent PET film support was replaced by a support prepared by the method described below, and subjected to the same tests as in Example 1. As a result, it has been confirmed that the present samples produced good results similar to those in Example 1 and achieved the effects characteristic of the invention.

1) Support

The support used in Example 2 was prepared in the following manner.

Polyethylene-2, 6-naphthalate polymer in an amount of 100 parts by weight, and 2 parts by weight of an ultraviolet absorbent Tinuvin P.326 (produced by Ciba-Geigy A. G.) were dried, and molten at 300° C. The molten matter was extruded from T-form die, and subjected to 3.3-fold longitudinal stretching at 140° C. and then to 3.3-fold traverse stretching at 130° C., and further to 6-second thermal fixation at 250° C., thereby preparing 90 μm-thick PEN film.

Additionally, in the PEN film were added in advance blue dyes, magenta dyes and yellow dyes (specifically I-1, I-4, I-6, I-24, I-26, I-27 and II-5 disclosed in *Kokai Gihou (Journal of Technical Disclosure)*, KoGi No. 94-6023) in proper amounts. Further, thermal hysteresis was given to the PEN film by winding the film onto a stainless roll having a diameter of 20 cm, and heating it at 110° C. for 48 hours, thereby making the film support hard to curl.

2) Coating of Subbing Layer

Furthermore, both surfaces of the film support were subjected to corona discharge, UV discharge and glow discharge treatments. On the high-temperature side at the time of stretching treatment, the discharge-treated support was coated with a subbing solution containing gelatin (0.1 g/m$^2$), sodium α-sulfodi-2-ethylhexylsuccinate (0.01 g/m$^2$), salicylic acid (0.04 g/m$^2$), p-chlorophenol (0.2 g/m$^2$), $(CH_2{=}CHSO_2CH_2CH_2NHCO)_2CH_2$ (0.012 g/m$^2$) and polyamide-epichlorohydrin polycondensate (0.2 g/m$^2$) at a coverage of 10 ml/m$^2$ by means of a bar coater. The drying was performed by 6-minute heating a 115° C. (the rollers installed in the drying zone and the carrying devices were all kept at 115° C.).

3) Coating of Backing Layers

After providing the subbing layer, the other side of the support was coated with an antistatic layer, a magnetic recording layer and a slipping layer having the following compositions respectively as backing layers.

3-1) Coating of Antistatic Layer

A fine grain dispersion of tin oxide-antimony oxide compound having an average grain size of 0.005 μm and specific resistance of 5 Ω·cm (secondary condensed grain size: about 0.08 μm) at the coverage of 0.08 g/m$^2$, 0.03 g/m$^2$ of gelatin, 0.02 g/m$^2$ of $(CH_2{=}CHSO_2CH_2CH_2NHCO)_2CH_2$ and 0.005 g/m$^2$ of polyoxyethylene(polymerization degree: 10)-p-nonylphenol were coated.

3-2) Coating of Transparent Magnetic Recording Layer

A dispersion containing 0.06 g/m$^2$ of Co-γ-iron oxide (specific surface area: 43 m$^2$/g; length: 0.14 μm; breadth: 0.03 μm; saturation magnetization: 89 emu/g; $Fe^{+2}/Fe^{+3}$ =6/94; the surface thereof was treated with aluminum oxide and silicon oxide in a proportion of 2 weight % to the iron oxide) coated with 3-polyoxyethylene(polymerization degree: 15)-propyl-oxytrimethoxysilane (15 weight %), 1.2 g/m$^2$ of diacetyl cellulose (the dispersion of the iron oxide was performed with an open kneader and a sand mill), 0.3 g/m$^2$ of $C_2H_5C(CH_2CONH{-}C_6H_3(CH_3)NCO)_3$ as hardener and a solvent constituted of acetone, methyl ethyl ketone, cyclohexanone and dibutyl phthalate was coated with a bar coater to form a 1.2 μm-thick magnetic recording layer. To the dispersion were added in advance $C_6H_{13}CH(OH)C_{10}H_{20}COOC_{40}H_{81}$ as slipping agent (50 mg/m$^2$), 50 mg/m$^2$ of silica grains (average grain size: 1.0 μm) as matting agent and 10 mg/m$^2$ of aluminum oxide (grain size: 0.20 μm and 1.0 μm) treated and coated with 3-polyoxyethylene(polymerization degree: 15)-propyloxytrimethoxysilane (15 weight %) as abrasive. The drying of the coated layer was performed by 6-minute heating at 115° C. (the rollers installed in the drying zone and the carrying devices were all kept at 115° C.). The increment in color density DE of the magnetic recording layer under X-light (blue filter) was about 0.1, and the saturated magnetic moment of the magnetic recording layer was 4.2 emu/g, the coercive force thereof was $7.3\times10^4$ A/m and the squareness ratio thereof was 65%.

3-3) Slipping Layer

A mixture of hydroxyethyl cellulose (25 mg/m$^2$), $C_6H_{13}CH(OH)C_{10}H_{20}COOC_{40}H_{81}$ (6 mg/m$^2$) and silicone oil BYK-310 (produced by Big Chimie Japan) (1.5 mg/m$^2$) was dissolved at 105° C. in 1:1 mixture of xylene and propylene glycol monomethyl ether, poured into 10-fold amount of propylene monomethyl ether having an ordinary temperature, made into a dispersion in an acetone medium (average particle size: 0.01 μm), and then coated. The drying of the coated layer was performed by 6-minute heating at 115° C. (the rollers installed in the drying zone and the carrying devices were all kept at 115° C.).

The slipping layer thus prepared had a kinetic friction coefficient of 0.10 (stainless ball of 5 mmϕ, load 100 g, speed 6 cm/min) and a static friction coefficient of 0.08 (Clip method). In addition, the kinetic friction coefficient between the slipping layer and the emulsion layer was 0.15. Therefore, it can be said that the slippability of this layer was excellent.

Color photographic materials according to the present invention enable simple and rapid image formation with a reduced load on environments.

Further, although they have reduced silver coverage, the present color photographic materials can achieve high photographic speed and appropriate gradation even when it undergoes simple and rapid processing.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having on the surface thereof constituent layers comprising three photosensitive silver halide emulsion layer units comprising at least two blue-sensitive silver halide emulsion layers having different photographic speeds, at least two green-sensitive silver halide emulsion layers having different photographic speeds, and at least two red-sensitive silver halide emulsion layers having different photographic speeds, and light-insensitive layers, wherein each of said three photosensitive silver halide emulsion layer units comprises a coupler, at least one of the blue-sensitive silver halide layers comprises a color developing agent, at least one of the green-sensitive silver halide layers comprises a color developing agent, and at least one of the red-sensitive silver halide layers comprises a color developing agent, said photographic material has a total silver coverage of at most 5.0 g/m$^2$, and at least one emulsion in a highest-speed emulsion layer of at least one of said three photosensitive silver halide emulsion layer units is a tabular silver halide emulsion that comprises tabular silver halide grains having an average thickness of from 0.05 to 0.20 μm and said tabular silver halide emulsion is an emulsion in which 100 to 80% of the total grains on a number basis are tabular silver halide grains having at least 10 dislocation lines per grain in their respective fringe parts.

2. The silver halide color photographic material as in claim 1, wherein said total silver coverage is at most 4 g/m$^2$.

3. The silver halide color photographic material as in claim 1, wherein said total silver coverage is at most 3 g/m$^2$.

4. The silver halide color photographic material as in claim 1, wherein said at least one emulsion comprised in the highest-speed emulsion layer of said photosensitive silver halide emulsion layers with the same color sensitivity is a tabular silver halide emulsion that comprises tabular grains having an average thickness of from 0.05 to 0.15 μm.

5. The silver halide color photographic material as in claim 1, wherein said at least one emulsion comprised in the highest-speed emulsion layer of said photosensitive silver halide emulsion layers with the same color sensitivity is a tabular silver halide emulsion that comprises tabular grains having an average thickness of from 0.05 to 0.10 $\mu$m.

6. The silver halide color photographic material as in claim 1, wherein at least one of said photosensitive silver halide emulsions is an emulsion comprising tabular silver halide grains having an average aspect ratio of 8 to 40.

7. The silver halide color photographic material as in claim 1, wherein said tabular silver halide emulsion is an emulsion comprising silver halide tabular grains in an amount of 100 to 50% based on the total grains on a number basis, in which the dislocation lines are localized substantially in the fringe part alone.

8. The silver halide color photographic material as in claim 1, wherein said silver halide tabular grains have at least one kind of photographically useful metal ion or complex in their respective insides.

9. The silver halide color photographic material as in claim 1, wherein said developing agent is at least one compound selected from the compounds represented by the following formulae (1) to (4):

(1)

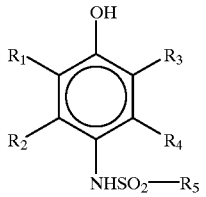

(2)

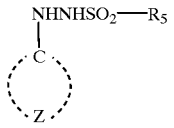

(3)

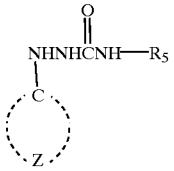

(4)

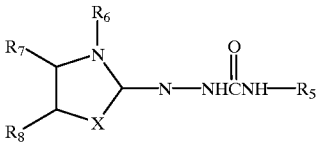

wherein each of $R_1$ to $R_4$ groups represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents an alkyl group, an aryl group or a heterocyclic group; Z represents atoms completing an aromatic carbocyclic or heterocyclic ring, and when the benzene ring completed by Z has substituent groups the sum total of the Hammett's $\sigma_p$ values of the substituent groups is at least 1; $R_6$ represents an alkyl group; X represents an oxygen atom, a sulfur atom, a selenium atom or a tertiary nitrogen atom having an alkyl or aryl substituent; and $R_7$ and $R_8$ each represents a hydrogen atom or a substituent group, or $R_7$ and $R_8$ combine with each other to form a double bond or a ring; provided that each of the compounds has solubility in oil by containing at least one ballast group having at least 8 carbon atoms.

10. The silver halide color photographic material as in claim 1; said photographic material being a heat developable photosensitive material in which the images are formed by a method comprising sequentially a step of exposing imagewise the photosensitive material, a step of supplying water to the photosensitive layer side of the photosensitive material or the processing layer side of a processing material comprising a support and a base and/or base precursor-containing processing layer, the amount of said water being controlled to the range of one-tenth to equivalent with the amount required for achieving the maximum of swelling in all the coated layers of these two materials, excepting the backing layers of both materials, a step of superimposing the photosensitive material upon a processing material in a condition that the processing layer and the light-sensitive layer face each other, and a step of heating the superimposed materials for a period of from 5 to 60 seconds at a temperature of from 60° C. to 100° C.

* * * * *